US010865058B2

(12) United States Patent
Nakamura et al.

(10) Patent No.: US 10,865,058 B2
(45) Date of Patent: Dec. 15, 2020

(54) SHEET FEEDING DEVICE, IMAGE FORMING APPARATUS INCORPORATING THE SHEET FEEDING DEVICE, AND DEVICE ATTACHMENT BODY OF THE SHEET FEEDING DEVICE

(71) Applicants: Mitsutaka Nakamura, Kanagawa (JP); Ikuo Fujii, Hyogo (JP)

(72) Inventors: Mitsutaka Nakamura, Kanagawa (JP); Ikuo Fujii, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/242,441

(22) Filed: Jan. 8, 2019

(65) Prior Publication Data

US 2019/0135560 A1 May 9, 2019

Related U.S. Application Data

(63) Continuation of application No. 15/608,269, filed on May 30, 2017, now Pat. No. 10,196,220.

(30) Foreign Application Priority Data

Jun. 2, 2016 (JP) ..... 2016-111199

(51) Int. Cl.
*B41J 13/12* (2006.01)
*B65H 1/06* (2006.01)
(Continued)

(52) U.S. Cl.
CPC ..... *B65H 1/06* (2013.01); *B65H 1/266* (2013.01); *B65H 3/54* (2013.01); *B65H 3/68* (2013.01);
(Continued)

(58) Field of Classification Search
CPC ... B65H 1/06; B65H 3/54; B65H 7/20; B65H 1/266; B65H 3/68; B65H 2404/71;
(Continued)

(56) References Cited

U.S. PATENT DOCUMENTS 4,828,245 A 5/1989 Shimogawara
5,238,238 A 8/1993 Shinohara et al.
(Continued)

FOREIGN PATENT DOCUMENTS

JP H05229676 A 9/1993
JP H10-129858 A 5/1998
(Continued)

OTHER PUBLICATIONS

Machine translation of JP 11-035175, published on Feb. 1999 (Year: 1999).*
(Continued)

*Primary Examiner* — Huan H Tran
(74) *Attorney, Agent, or Firm* — Harness, Dickey & Pierce, P.L.C.

(57) ABSTRACT

A sheet feeding device, which is included in an image forming apparatus and includes a device attachment body, includes a sheet container configured to accommodate a sheet, a support configured to support a lower face of the sheet in the sheet container, a sheet width regulator configured to regulate a position of the sheet in a sheet width direction, a conveying force applier configured to apply a sheet conveying force in a sheet conveying direction to the sheet in the sheet container, and a sheet guide disposed above the sheet in the sheet container and configured to regulate movement of the sheet in an upper direction.

13 Claims, 20 Drawing Sheets

(51) Int. Cl.

| | |
|---|---|
| ***B65H 3/54*** | (2006.01) |
| ***B65H 3/68*** | (2006.01) |
| ***B65H 1/26*** | (2006.01) |
| ***B65H 7/20*** | (2006.01) |
| *B41J 11/00* | (2006.01) |
| *B65H 7/02* | (2006.01) |

(52) U.S. Cl.
CPC ..... *B65H 7/20* (2013.01); *B41J 11/0045* (2013.01); *B41J 11/0055* (2013.01); *B65H 7/02* (2013.01); *B65H 2404/71* (2013.01); *B65H 2405/115* (2013.01); *B65H 2405/11425* (2013.01); *B65H 2511/216* (2013.01); *B65H 2701/1123* (2013.01); *B65H 2701/132* (2013.01); *B65H 2701/1916* (2013.01)

(58) Field of Classification Search
CPC ..... B65H 2701/1123; B65H 2701/132; B65H 2405/11425; B65H 2511/216; B65H 2405/115; B65H 7/02; B65H 2701/1916; H05K 999/99
See application file for complete search history.

(56) References Cited

U.S. PATENT DOCUMENTS

| | | | | |
|---|---|---|---|---|
| 5,320,338 | A | 6/1994 | Shinohara et al. | |
| 9,714,146 | B2 | 7/2017 | Ishida et al. | |
| 10,196,220 | B2 * | 2/2019 | Nakamura ..... | B65H 1/06 |
| 2003/0141652 | A1 | 7/2003 | Guddanti et al. | |
| 2010/0225041 | A1 | 9/2010 | Matsuyama et al. | |
| 2016/0109841 | A1 | 4/2016 | Horita et al. | |
| 2016/0200531 | A1 | 7/2016 | Ishida et al. | |

FOREIGN PATENT DOCUMENTS

| | | | |
|---|---|---|---|
| JP | H10129855 | A | 5/1998 |
| JP | H10129864 | A | 5/1998 |
| JP | H1103515175 | A | 2/1999 |
| JP | 2004269070 | A | 9/2004 |
| JP | 2005-001783 | A | 1/2005 |
| JP | 2006103949 | A | 4/2006 |
| JP | 2007030996 | A | 2/2007 |
| JP | 2008222387 | A | 9/2008 |
| JP | 2009057170 | A | 3/2009 |
| JP | 2010-058962 | A | 3/2010 |
| JP | 2012188285 | A | 10/2012 |
| JP | 2015160730 | A | 9/2015 |
| JP | 2015222313 | A | 12/2015 |

OTHER PUBLICATIONS

Machine translation of JP 10-129864, published on May 1998. (Year: 1998).*
Machine translation of JP 05-229676, published on Sep. 1993 (Year: 1993).*
Machine translation of JP 2005-001783, published on Jan. 2005 (Year: 2005).*
Office Action for co-pending U.S. Appl. No. 15/608,269, dated Mar. 8, 2018.
Notice of Allowance and Fee(s) Due for co-pending U.S. Appl. No. 15/608,269 dated Sep. 20, 2018.
Japanese Office Action dated Jan. 17, 2020 for corresponding Japanese Application No. 2016-111199.
Japanese Office Action dated Jun. 12, 2020 for corresponding Japanese Application No. 2016-111199.

* cited by examiner

SHEET FEEDING DEVICE, IMAGE FORMING APPARATUS INCORPORATING THE SHEET FEEDING DEVICE, AND DEVICE ATTACHMENT BODY OF THE SHEET FEEDING DEVICE

CROSS-REFERENCE TO RELATED APPLICATION

This application is a continuation application of U.S. application Ser. No. 15/608,269, filed on May 30, 2017, which is based on and claims priority pursuant to 35 U.S.C. § 119(a) to Japanese Patent Application No. 2016-111199, filed on Jun. 2, 2016, in the Japan Patent Office, the entire disclosure of which is hereby incorporated by reference herein.

BACKGROUND

Technical Field

This disclosure relates to a sheet feeding device, an image forming apparatus incorporating the sheet feeding device, and a device attachment body of the sheet feeding device.

Related Art

Various types of electrophotographic image forming apparatuses are known to include a sheet feeding device to feed a sheet material to an image forming device of the image forming apparatus. Such sheet feeding devices include a sheet width regulator such as a side fence to regulate a position in a sheet width direction perpendicular to a sheet conveying direction in a sheet feed tray. Further, sheet feeding devices are known to include a frictional separator such as a separation pad to separate a sheet to which a sheet conveying force applier applies a conveying force, from other sheets.

For example, a sheet feeding device has a configuration in which an envelope that functions as a sheet material is set in a sheet feed tray.

SUMMARY

At least one aspect of this disclosure provides a sheet feeding device including a sheet container, a support, a sheet width regulator, a conveying force applier, and a sheet guide. The sheet container is configured to accommodate a sheet. The support is configured to support a lower face of the sheet in the sheet container. The sheet width regulator is configured to regulate a position of the sheet in a sheet width direction. The conveying force applier is configured to apply a sheet conveying force in a sheet conveying direction to the sheet in the sheet container. The sheet guide is disposed above the sheet in the sheet container and is configured to regulate movement of the sheet in an upper direction.

Further, at least one aspect of this disclosure provides an image forming apparatus including the above-described sheet feeding device and an image forming device configured to form an image on the sheet.

Further, at least one aspect of this disclosure provides a device attachment body including at least one cut portion. The device attachment body is configured to be attached to the support configured to support the lower face of the sheet in the sheet container of the sheet feeding device. The device attachment body includes the device attachment body to be provided to the sheet feeding device.

DETAILED DESCRIPTION

Figure 1A:
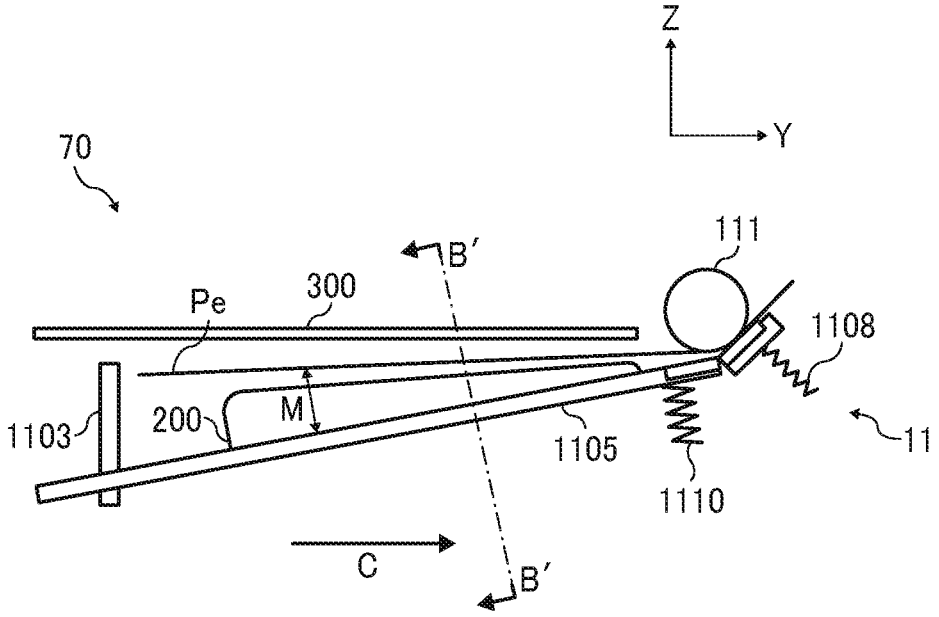
FIG. 1A is a diagram illustrating a sheet feeding device according to an embodiment of this disclosure, when feeding a flap envelope.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus according to an embodiment of this disclosure, with reference to drawings.

It is to be noted that identical parts are given identical reference numerals and redundant descriptions are summarized or omitted accordingly.

Now, a description is given of an electrophotographic image forming apparatus 100 for forming images by electrophotography according to an embodiment of this disclosure. In the present embodiment, the image forming apparatus 100 includes a color laser printer but the configuration is not limited thereto. For example, a monochrome image forming apparatus, a copier, a multifunction peripheral and the like can be applied to the image forming apparatus 100.

At first, a description is given of a basic configuration of the image forming apparatus 100 according to an embodiment of this disclosure.

Figure 2:
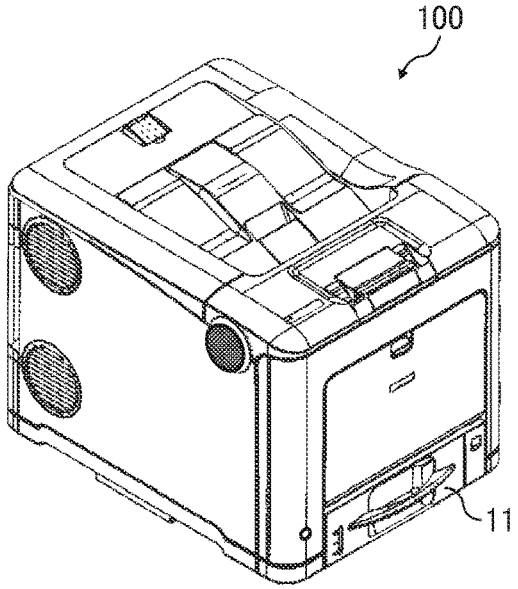
FIG. 2 is a perspective view illustrating an image forming apparatus according to an embodiment of this disclosure.
Figure 3:
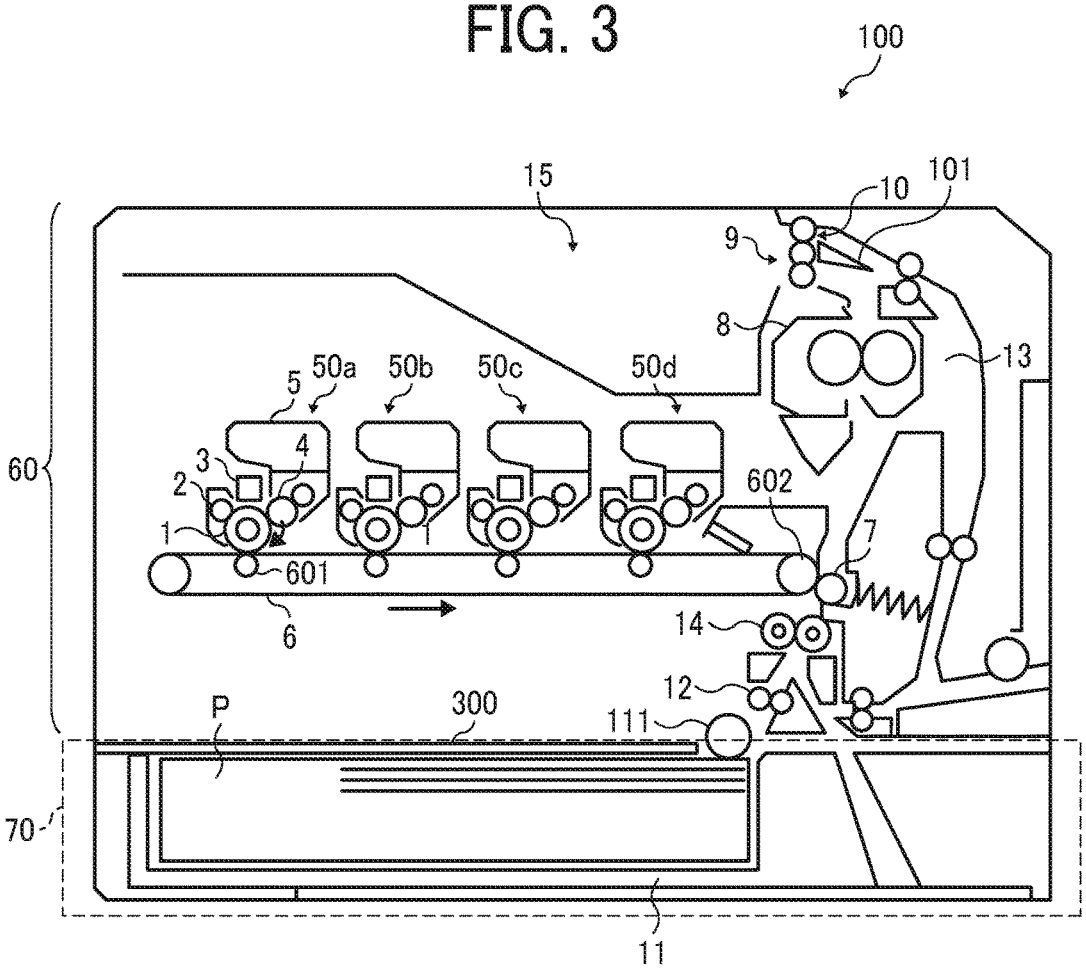
FIG. 3 is a diagram illustrating the image forming apparatus of FIG. 2.

FIG. 2 is a perspective view illustrating the image forming apparatus 100 according to an embodiment of this disclosure. FIG. 3 is a diagram illustrating the image forming apparatus 100 of FIG. 2.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic color laser printer that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

As illustrated in FIG. 2, the image forming apparatus 100 includes an image forming device 60 and a sheet feeding device 70 disposed below the image forming device 60.

As illustrated in FIG. 3, the image forming device 60 includes an intermediate transfer belt 6 that functions as an intermediate transfer body. The surface of the intermediate transfer belt 6 moves in a direction as indicated by arrow in FIG. 3, so that the intermediate transfer belt 6 rotates in a counterclockwise direction in FIG. 3. Four image forming units 50*a*, 50*b*, 50*c*, and 50*d* are disposed above the intermediate transfer belt 6, aligned along a belt moving direction of the intermediate transfer belt 6. The four image forming units 50*a*, 50*b*, 50*c*, and 50*d* form respective single color images using corresponding toners, which are black, magenta, cyan, and yellow toners. The four image forming units 50*a*, 50*b*, 50*c*, and 50*d* have substantially the same configuration except for containing different color toners of black (K), magenta (M), cyan (C), and yellow (Y) to be used for forming the respective single color images. Hereinafter, the four image forming units 50*a*, 50*b*, 50*c*, and 50*d* are occasionally referred to in a single form as the image forming unit 50.

The image forming unit 50 (i.e. the image forming units 50*a*, 50*b*, 50*c*, and 50*d*) includes a photoconductor 1, a charging device 2, a light emitting diode (LED) 3, a developing device 4, and a developer cartridge 5. The photoconductor 1 functions as a rotatable image bearer. The charging device 2 uniformly charges a surface of the photoconductor 1. The LED 3 functions as a light source to emit a laser light beam onto the charged surface of the photoconductor 1 so as to form an electrostatic latent image on the photoconductor 1. The developing device 4 supplies toner onto the electrostatic latent image formed on the surface of the photoconductor 1 so as to develop the electrostatic latent image into a visible toner image. The developer cartridge 5 contains developer to be supplied to the developing device 4.

The photoconductor 1 of the image forming unit 50 is disposed facing a primary transfer roller 601 that is disposed in a loop of the intermediate transfer belt 6. The photoconductor 1 and the primary transfer roller 601 hold the intermediate transfer belt 6, where a primary transfer nip region is formed. In the primary transfer nip region, a toner image formed on the surface of the photoconductor 1 is transferred onto a surface of the intermediate transfer belt 6 as primary transfer. The respective toner images formed on the four image forming units 50*a*, 50*b*, 50*c*, and 50*d* are sequentially transferred in layers onto the intermediate transfer belt 6. By so doing, a color toner image is formed on the surface of the intermediate transfer belt 6.

A secondary transfer roller 7 is disposed on the right side of the intermediate transfer belt 6 in FIG. 3. The secondary transfer roller 7 transfers the color toner image formed on the surface of the intermediate transfer belt 6 onto a sheet P (a recording medium). The secondary transfer roller 7 is disposed facing a secondary transfer opposing roller 602 that is disposed in the loop of the intermediate transfer belt 6. The secondary transfer roller 7 and the secondary transfer opposing roller 602 hold the intermediate transfer belt 6, where a secondary transfer nip region is formed. In the secondary transfer nip region, the color toner image formed on the surface of the intermediate transfer belt 6 is transferred onto the sheet P as secondary transfer.

As illustrated in FIG. 3, the sheet feeding device 70 includes a sheet feed tray 11. The sheet feed tray 11 functions as a sheet container to load the sheet P or a bundle of sheets P thereon. The sheet feed tray 11 is detachably attachable to an apparatus body of the image forming apparatus 100.

The sheet feeding device 70 further includes a sheet feed roller 111 that feeds an uppermost sheet placed on top of the bundle of sheets P loaded on the sheet feed tray 11 and separates the uppermost sheet form other subsequent sheets. The sheet feed roller 111 then transfers the sheet P to a pair of sheet conveying rollers 12 that is disposed downstream from the sheet feed roller 111 in a sheet conveying direction.

A pair of registration rollers 14 is disposed above the pair of sheet conveying rollers 12 in the image forming device 60. The pair of registration rollers 14 causes the sheet P fed from the sheet feeding device 70 to temporarily slacken or warp, and then transfer the sheet P toward the secondary transfer nip region that is disposed downstream from the pair of registration rollers 14 in the sheet conveying direction, in synchronization with movement of the color toner image formed on the intermediate transfer belt 6, that is, in synchronization with a transfer timing.

The image forming device 60 further includes a fixing device 8 and a sheet output device 9. The fixing device 8 is disposed above the secondary transfer nip region to fix the color toner image transferred onto the sheet P to the sheet P. The sheet output device 9 is disposed above the fixing device 8 to eject or output the sheet P having the fixed color toner image thereon to an outside of the image forming apparatus 100.

A sheet stacking portion 15 that stacks the sheet P output by the sheet output device 9 is provided on an upper exterior face of the image forming device 60.

A sheet reversing device 10 is provided above the sheet output device 9. The sheet reversing device 10 guides the sheet P with an image formed on a first face thereof toward a duplex sheet conveyance passage 13 when the sheet P is processed in a duplex printing mode.

A separation claw 101 is provided above the fixing device 8 to switch a direction of conveyance of the sheet P that has passed the fixing device 8, between the sheet output device 9 and the sheet reversing device 10.

Further, the duplex sheet conveyance passage 13 is provided on the right side of the fixing device 8 of the image forming device 60 in FIG. 3. The duplex sheet conveyance passage 13 causes the sheet P that has the image on the first face and is conveyed from the sheet reversing device 10, to convey toward the pair of registration rollers 14.

As illustrated in FIG. 3, the sheet feeding device 70 of the image forming apparatus 100 according to the present embodiment includes a sheet upper face guide plate 300 that is disposed above the sheet P or the bundle of sheets P accommodated in the sheet feed tray 11. The sheet upper face guide plate 300 regulates movement of the sheet P in an upper direction.

Figure 4:
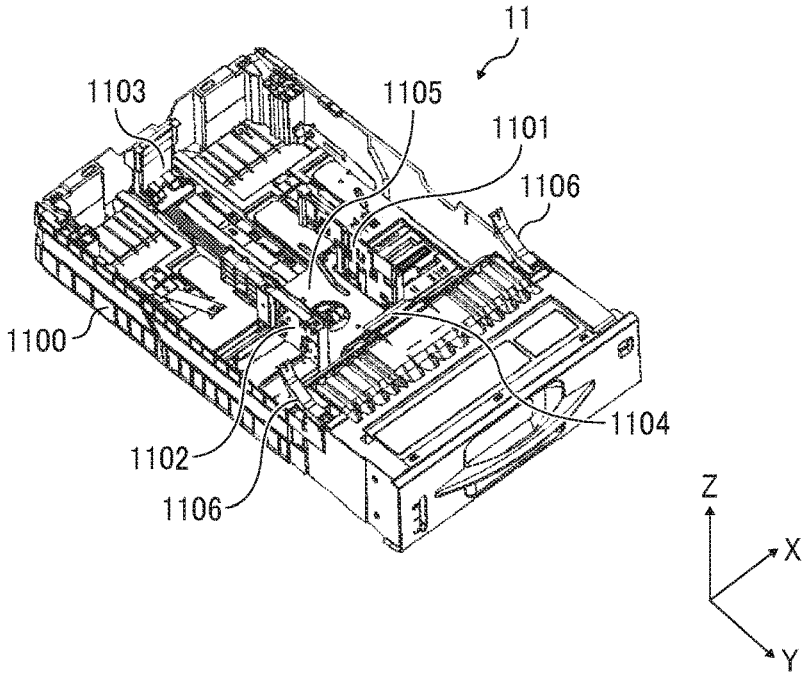
FIG. 4 is a perspective view illustrating a sheet feed tray included in the image forming apparatus of FIG. 2.

FIG. 4 is a perspective view illustrating the sheet feed tray 11 that functions as a sheet container included in the image forming apparatus 100 of FIG. 2.

As illustrated in FIG. 4, the sheet feed tray 11 includes a sheet tray housing 1100 that has a space to accommodates the sheet P. The sheet tray housing 1100 has a box shape and an upper portion thereof is open. The sheet feed tray 11 further includes a first side fence 1101, a second side fence 1102, an end fence 1103, and a bottom plate 1105. The first side fence 1101 and the second side fence 1102 are both movable in a width direction of the sheet tray housing 1100 (i.e., an X axis direction in FIG. 4) so as to regulate a lateral position in a width direction of the sheet P set in the sheet feed tray 11. The end fence 1103 is movable in a direction parallel to the sheet conveying direction (i.e., a Y axis direction in FIG. 4) so as to regulate an upper end position in the sheet conveying direction of the sheet P set in the sheet feed tray 11.

The sheet feed tray 11 includes a bottom plate 1105 that has a downstream side end (in the sheet conveying direction) movable in a vertical direction (i.e., a Z axis direction in FIG. 4). As the sheet feed tray 11 is inserted into the apparatus body of the image forming apparatus 100, an engaging portion that is provided to the apparatus body engages with a link 1106. Due to the engagement of the engaging portion and the link 1106, the link 1106 rises, and the downstream side end of the bottom plate 1105 rises along with the rise of the link 1106.

As illustrated in FIG. 4, the sheet feed tray 11 further includes a separation pad 1104 disposed downstream from the space of the sheet feed tray 11 to accommodate the sheet P in the sheet conveying direction. The separation pad 1104 holds the sheet P (a preceding sheet) together with the sheet feed roller 111 and prevents a sheet (a subsequent sheet) contacting thereto from being conveyed toward the downstream side by a frictional force applied by a surface thereof while the sheet feed roller 111 rotates. By so doing, the sheet contacting the separation pad 1104 is separated from the sheet P to which the sheet feed roller 111 applies a conveying force. Accordingly, the sheet feed roller 111 can separate an uppermost sheet P (a preceding sheet) that is placed on top of the bundle of sheets P set in the sheet feed tray 11 from the other sheets P (subsequent sheets), and convey the uppermost sheet P further to the downstream side in the sheet conveying direction.

Figure 5A:
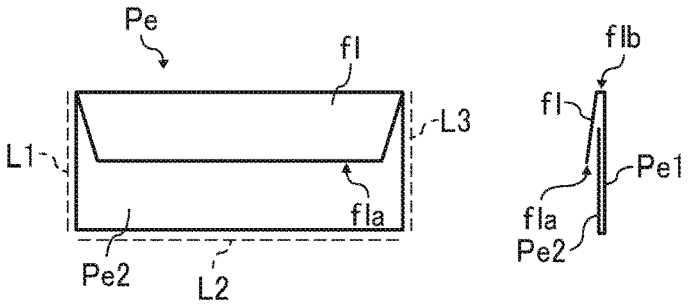
FIG. 5A is a diagram illustrating a plan view and a right side view of a flap side of a flap envelope.
Figure 5B:
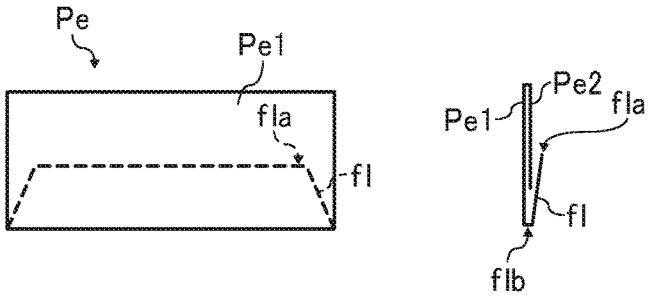
FIG. 5B is a diagram illustrating a plan view and a right side view of a non-flap side of the flap envelope of FIG. 5A.

FIG. 5A is a diagram illustrating a plan view and a right side view of a flap side (i.e., the back face Pe2) of a flap envelope Pe that has a flap fl. FIG. 5B is a diagram illustrating a plan view and a right side view of a non-flap side (i.e., the front face Pe1) of the flap envelope Pe that does not have the flap fl of FIG. 5A. In FIG. 5B, the flap fl is indicated with a broken line since the flap fl is on the back face Pe2 of the flap envelope Pe.

Generally, the front face Pe1 and the back face Pe2 are joined by sealing and folding at three broken line edges (L1, L2, and L3) of four line edges in FIG. 5A, which form an external form of the envelopes. By contrast, an edge line fla of the flap fl of the flap envelope Pe is not fixed to belong to either the front face Pe1 or the back face Pe2 of the flap envelope Pe.

Figure 6:
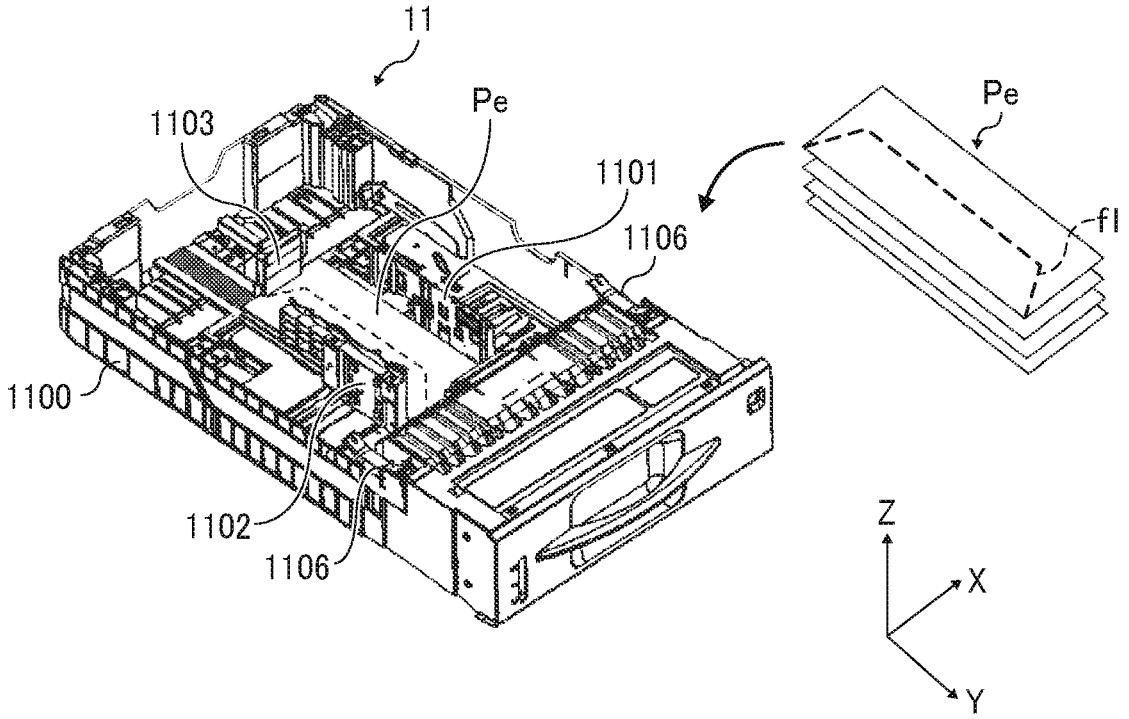
FIG. 6 is a perspective view illustrating the sheet feed tray on which flap envelopes are to be loaded.

FIG. 6 is a perspective view illustrating the sheet feed tray 11 on which flap envelopes Pe are to be loaded.

The sheet feed tray 11 is pulled out from the apparatus body of the image forming apparatus 100. At this time, the first side fence 1101 and the second side fence 1102 are moved to a position at which the envelope Pe is regulated in the width direction. Then, the end fence 1103 is moved to a position at which the envelope Pe is regulated in the sheet conveying direction. Thereafter, the envelope Pe is set on the sheet feed tray 11. Accordingly, the position of the envelope Pe can be regulated both in the width direction and in the sheet conveying direction.

Alternatively, the envelope Pe may be set in the sheet feed tray 11 first. Then, the first side fence 1101 and the second side fence 1102 may be moved to regulate the position of the envelope Pe in the width direction and the end fence 1103 may be moved to regulate the position of the envelope Pe in the sheet conveying direction. One or more envelopes Pe can be set in the sheet feed tray 11.

FIG. 6 is a perspective view illustrating the sheet feed tray 11 on which the envelopes Pe are to be loaded with the flap fl facing down.

In the image forming apparatus 100 illustrated in FIG. 3, the image is formed on the front side of the sheet P (i.e., the envelope Pe) that is set in the sheet feed tray 11. Therefore, in a state in which the envelope Pe is set in the sheet feed tray 11 as illustrated in FIG. 6, the front face Pe1 of the envelope Pe is not provided with the flap fl and functions as an image forming face, and a fold fib of the flap fl functions as a boundary between the front face Pe1 and the flap fl and extends in parallel to the sheet conveying direction (i.e., to the Y axis direction).

Figure 7A:
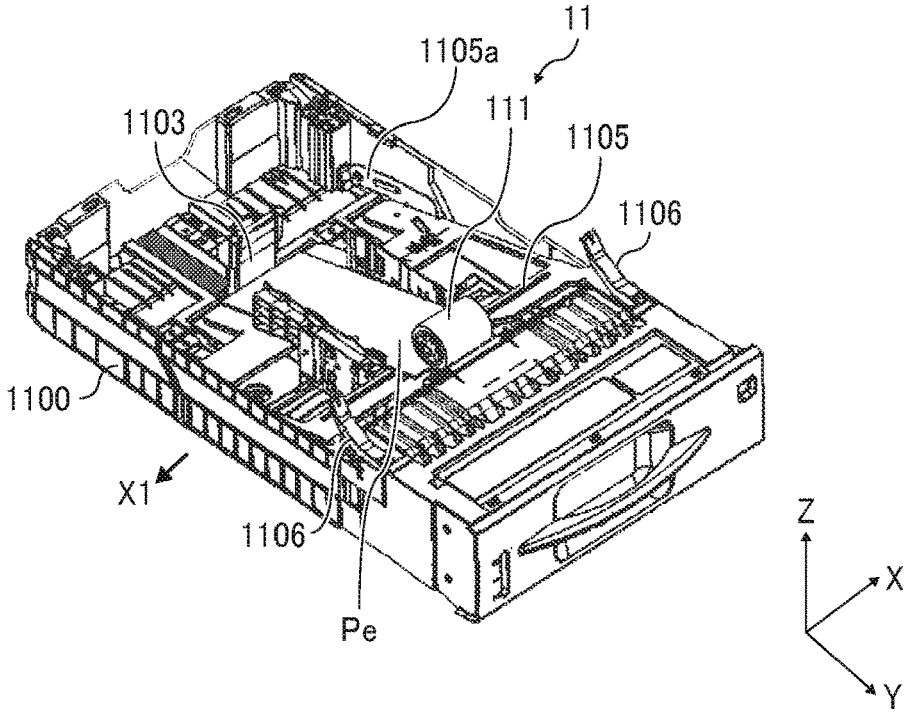
FIG. 7A is a perspective view illustrating the sheet feed tray set in an apparatus body of the image forming apparatus.
Figure 7B:
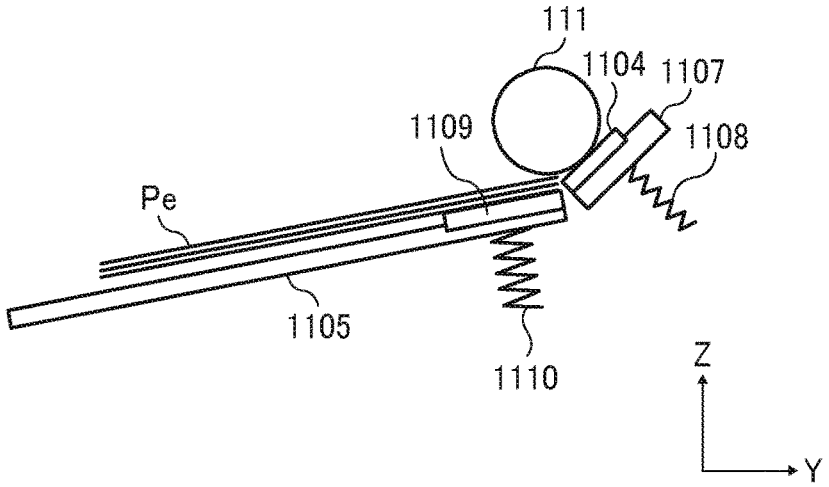
FIG. 7B is a diagram illustrating the sheet feed tray of FIG. 7A, viewed from X1.

Now, a description is given of the sheet feeding device 70 of the image forming apparatus 100 with reference to FIGS. 7A through 10B. The sheet feeding device 70 includes the sheet feed tray 11 and does not include the sheet upper face guide plate 300. FIG. 7A is a perspective view illustrating the sheet feed tray 11 inserted and set in the apparatus body of the image forming apparatus 100. FIG. 7B is a diagram illustrating the sheet feed tray 11 of FIG. 7A, viewed from X1, which is a negative direction of the X axis direction.

The bottom plate 1105 is coupled to the link 1106 via a sheet feed spring 1110 and is biased upwardly by the sheet feed spring 1110 toward the link 1106 that is located at a position higher than the bottom plate 1105.

As illustrated in FIG. 7A, when the sheet feed tray 11 is inserted into the apparatus body of the image forming apparatus 100, the engaging portion provided to the apparatus body of the image forming apparatus 100 engages with the link 1106, and the link 1106 rises due to the engagement of the engaging portion and the link 1106. The downstream side of the bottom plate 1105 on which the envelope Pe is loaded rises such that the bottom plate 1105 rotates about a bottom plate rotary shaft 1105*a* along with the rise of the link 1106. As the downstream side of the bottom plate 1105 rises, the bundle of envelopes Pe contacts the sheet feed roller 111 that is provided to the apparatus body of the image forming apparatus 100. At this time, the bundle of envelopes Pe is biased to the sheet feed roller 111 via a sheet feed pad 1109 that is provided in the vicinity of the downstream side end of the bottom plate 1105 in the sheet conveying direction by a biasing force of the sheet feed spring 1110.

Figure 8A:
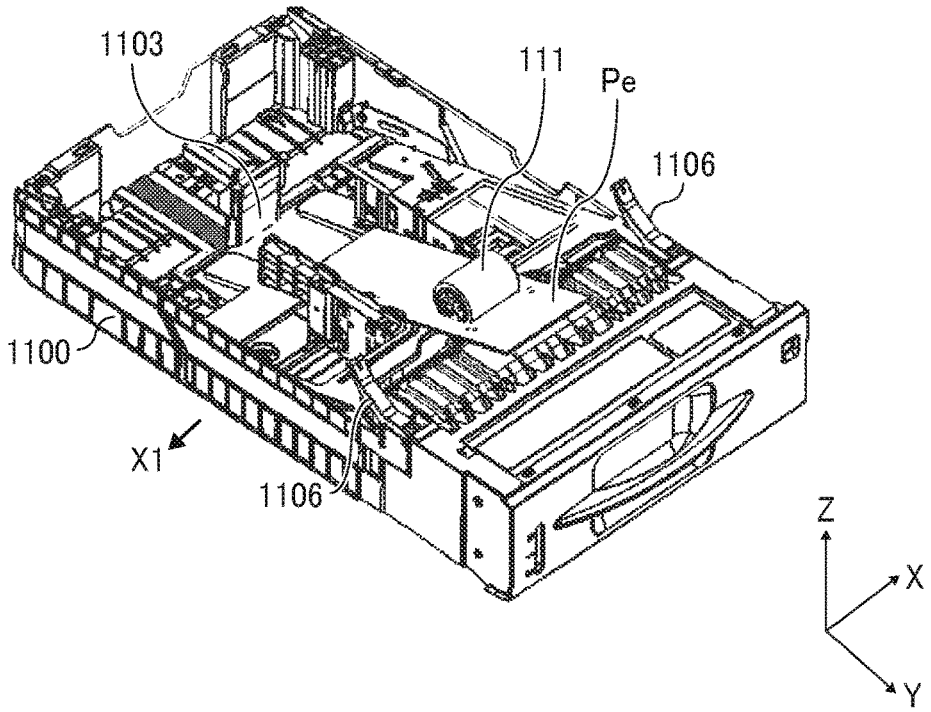
FIG. 8A is a perspective view illustrating the sheet feed tray in a state in which the flap envelope is being fed from the sheet feed tray.
Figure 8B:
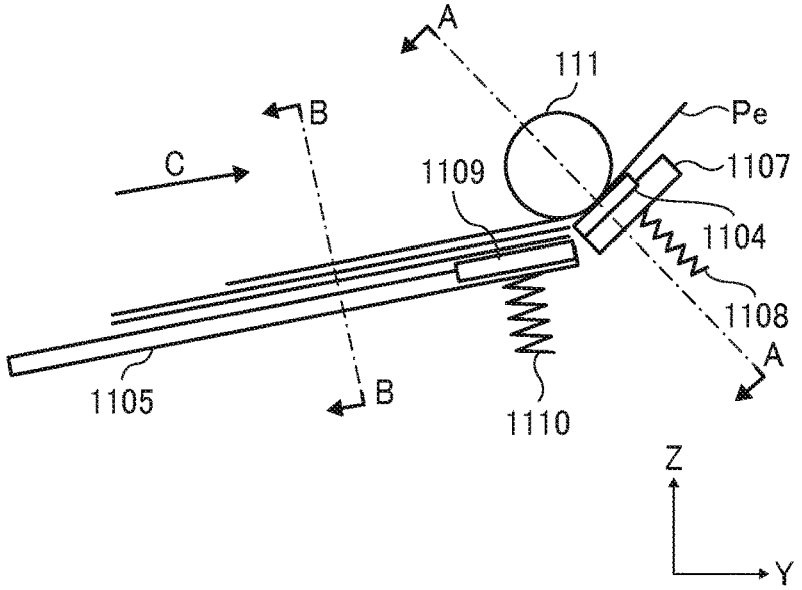
FIG. 8B is a diagram illustrating the sheet feed tray of FIG. 8A, viewed from X1.

FIG. 8A is a perspective view illustrating the sheet feed tray 11 in a state in which the envelope Pe with the flap fl is being fed from the sheet feed tray 11. FIG. 8B is a diagram illustrating the sheet feed tray of FIG. 8A, viewed from X1. Arrow C in FIG. 8B indicates the sheet conveying direction.

When a print job is inputted, the sheet feed roller 111 rotates to feed the envelope Pe. The sheet feed roller 111 and a separation pad 1104 that is biased by a force of a separation spring 1108 form a sheet separation section. At the sheet separation section located downstream from a sheet feeding position facing a sheet feed pad 1109, an uppermost envelope Pe placed on top of the bundle of envelopes Pe is separated from the other envelopes Pe so as to be conveyed toward the downstream side of the sheet conveying direction.

Figure 9A:
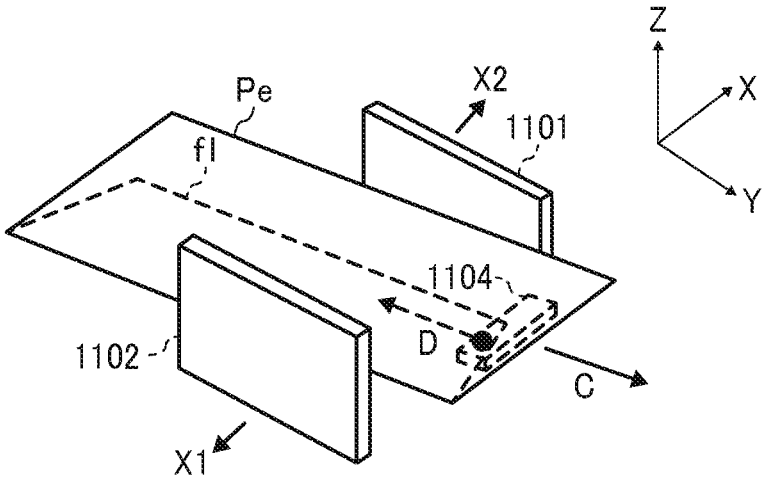
FIG. 9A is a perspective view illustrating a state immediately after the flap envelope has entered a sheet separation section.
Figure 9B:
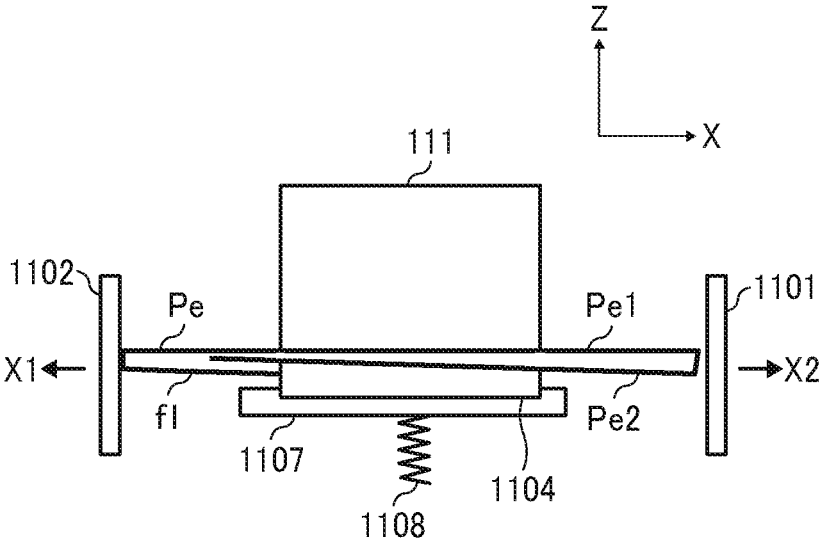
FIG. 9B is a cross sectional view illustrating the sheet separation section of FIG. 9A, viewed from a downstream side of the sheet conveying direction along a line A-A of FIG. 8B.

FIG. 9A is a perspective view illustrating a state immediately after the envelope Pe has entered the sheet separation section. FIG. 9B is a cross sectional view illustrating the sheet separation section of FIG. 9A, viewed from the downstream side of the sheet conveying direction along a line A-A of FIG. 8B.

As illustrated in FIG. 9A, the envelope Pe is conveyed while the flap fl is in contact with the separation pad 1104. However in reality, the flap fl and the separation pad 1104 are not contact with each other in a uniform manner in the width direction (i.e., in the X axis direction).

As illustrated in FIG. 9B, the flap fl and the separation pad 1104 contact with each other at a side edge of the separation pad 1104 on the side indicated by X1. The other side edges of the separation pad 1104 are in contact with the back side P2 of the envelope Pe.

As illustrated in FIG. 9B, the sheet separation section separates multiple sheets (for example, the sheets P and the envelopes Pe) that entered thereto due to cooperation by the sheet feed roller 111 and the separation pad 1104 that is biased by the separation spring 1108. When the envelope Pe with the flap fl enters the sheet separation section, the flap fl is being separated from the back face Pe2 of the envelope Pe in a direction indicated by arrow D in FIG. 9A in a region on the side indicated by X1 where the flap fl contacts the separation pad 1104.

In a region where the back face Pe2 of the envelope Pe is in contact with the separation pad 1104 (that is a side indicated as X2, which is a positive direction of the X axis direction), the back face Pe2 of the envelope Pe is being separated from the front face Pe1 of the envelope Pe. At this time, since the front face Pe1 and the back face Pe2 of the envelope Pe are joined by three line edges of four line edges that form the external form of the envelope Pe as described with reference to FIG. 5, the flap fl is not separated from the envelope Pe but is conveyed in a unit form. Eventually, the flap fl alone is being attempted to separate from the other part of the envelope Pe.

Figure 10A:
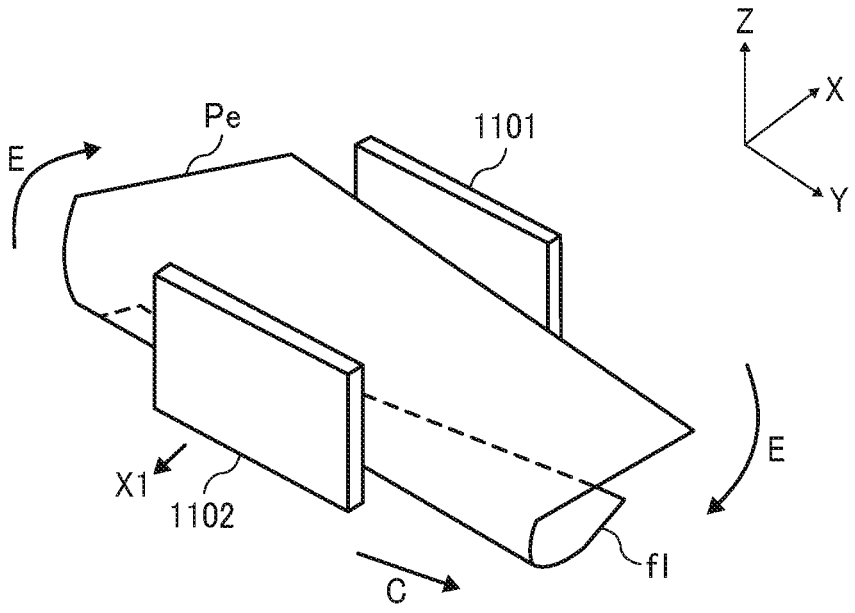
FIG. 10A is a perspective view illustrating a state in which the flap envelope has been conveyed further in the sheet conveying direction from the state of FIG. 9A.
Figure 10B:
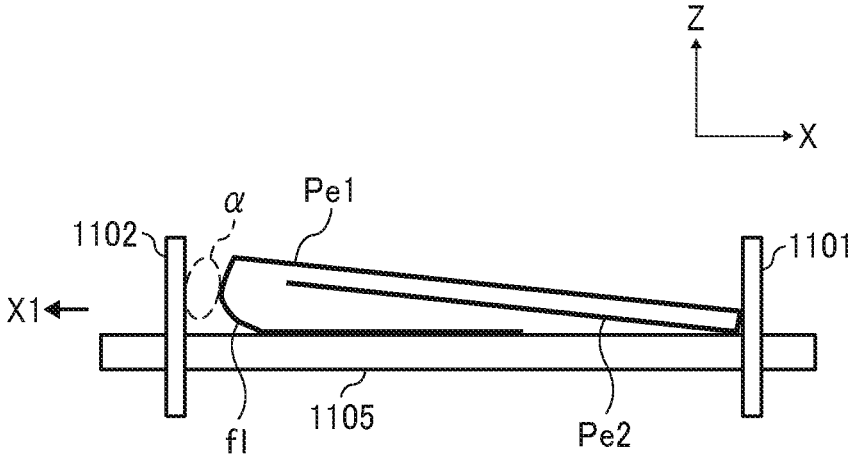
FIG. 10B is a cross sectional view illustrating the sheet separation section of FIG. 10A, viewed from the downstream side of the sheet conveying direction along a line B-B of FIG. 8B.

FIG. 10A is a perspective view illustrating a state in which the envelope Pe with the flap fl has been conveyed further in the sheet conveying direction from the state of FIG. 9A. FIG. 10B is a cross sectional view illustrating the sheet separation section of FIG. 10A, viewed from the downstream side of the sheet conveying direction along a line B-B of FIG. 8B.

As the envelope Pe is further conveyed from the state of FIG. 9A, the flap fl is continuously being separated from the envelope Pe, as illustrated in FIG. 10A. Therefore, the flap fl remains on the upstream side of the sheet conveying direction. Accordingly, the flap fl changes the shape to be outwardly expanding, and the front face Pe1 of the envelope Pe starts to rise on the fold side (i.e., on the X1 side in FIG. 10B) at the boundary of the flap fl and the front face Pe1 of the envelope Pe in the width direction.

The cross section of the sheet separation section along the line B-B of FIG. 8B illustrated in FIG. 10B is located upstream from the sheet feed pad 1109 in the sheet conveying direction. FIG. 10B depicts the cross section of the sheet separation section viewed from the downstream side of the sheet conveying direction (i.e., the Y axis direction). As one end of the envelope Pe in the width direction rises and the position of the envelope Pe deviates diagonally, a gap a is generated between the second side fence 1102 to which the fold of the flap fl and the front face Pe1 of the envelope Pe contacts and the one end of the envelope Pe in the width direction. Due to the gap a, the side fences (i.e., the first side fence 1101 and the second side fence 1102) cannot regulate the width direction of the envelope Pe.

At the same time, since the flap fl remains on the upstream side of the sheet conveying direction, conveyance of the envelope Pe on the side in the width direction where the flap fl is provided delays, and therefore the envelope Pe rotates in a direction indicated by arrow E in FIG. 10A.

Consequently, when the envelope Pe is continuously conveyed while the width direction of the envelope Pe is not regulated and the envelope Pe is rotated in the direction E, failure in sheet conveyance such as skew (inclination) of the envelope Pe and diagonal folding of the flap fl can occur.

Accordingly, when a comparative sheet feeding device without a sheet upper face guide plate feeds an envelope with a flap, skew (inclination) of the envelope and diagonal folding of the flap occur due to rise of the envelope Pe.

Figure 11A:
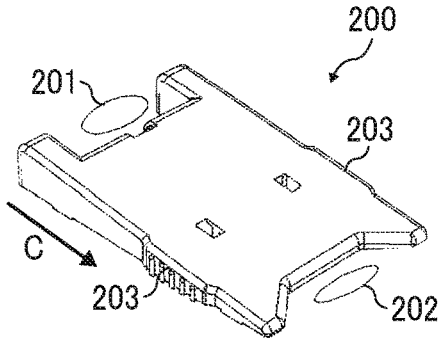
FIG. 11A is a perspective view illustrating a device attachment viewed from an upper face side thereof.
Figure 11B:
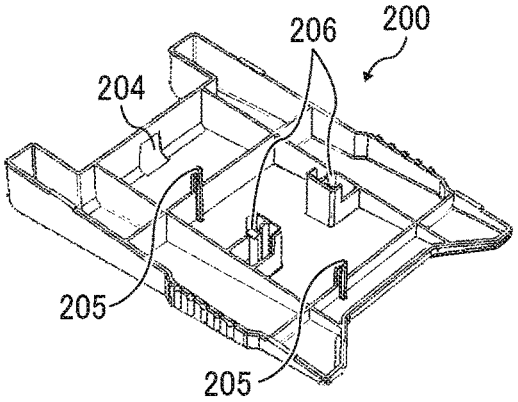
FIG. 11B is a perspective view illustrating the device attachment viewed from a lower face side thereof.
Figure 11C:
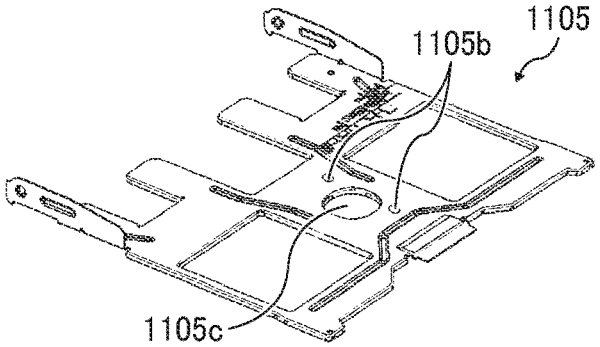
FIG. 11C is a perspective view illustrating a bottom plate viewed from an upper face side thereof.

FIGS. 11A through 11C are diagrams illustrating a device attachment 200 that is detachably attachable to the sheet feed tray 11 of the sheet feeding device 70 and the bottom plate 1105 to which the device attachment 200 is attached, according to an embodiment of this disclosure. Specifically, FIG. 11A is a perspective view illustrating the device attachment 200 viewed from an upper face side thereof. FIG. 11B is a perspective view illustrating the device attachment 200 viewed from a lower face side thereof. FIG. 11C is a perspective view illustrating the bottom plate 1105 viewed from the upper face side thereof.

Figure 12A:
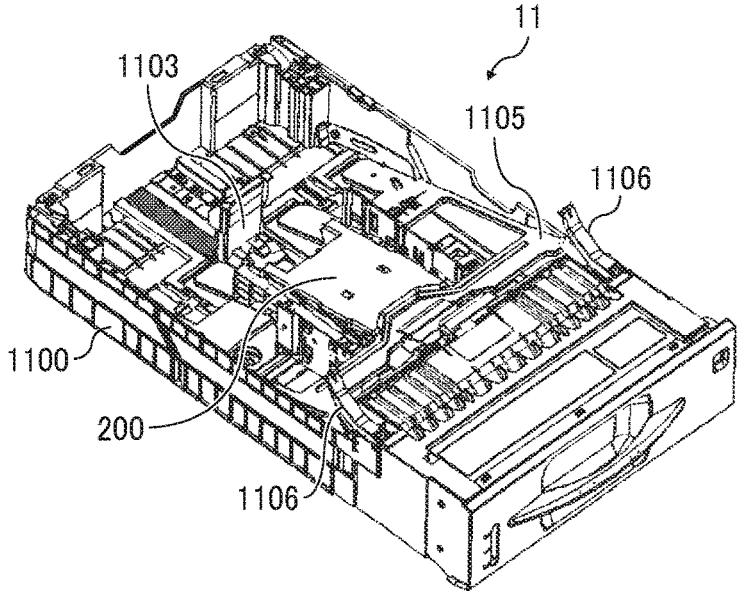
FIG. 12A is a perspective view illustrating the sheet feed tray with the device attachment attached thereto.
Figure 12B:
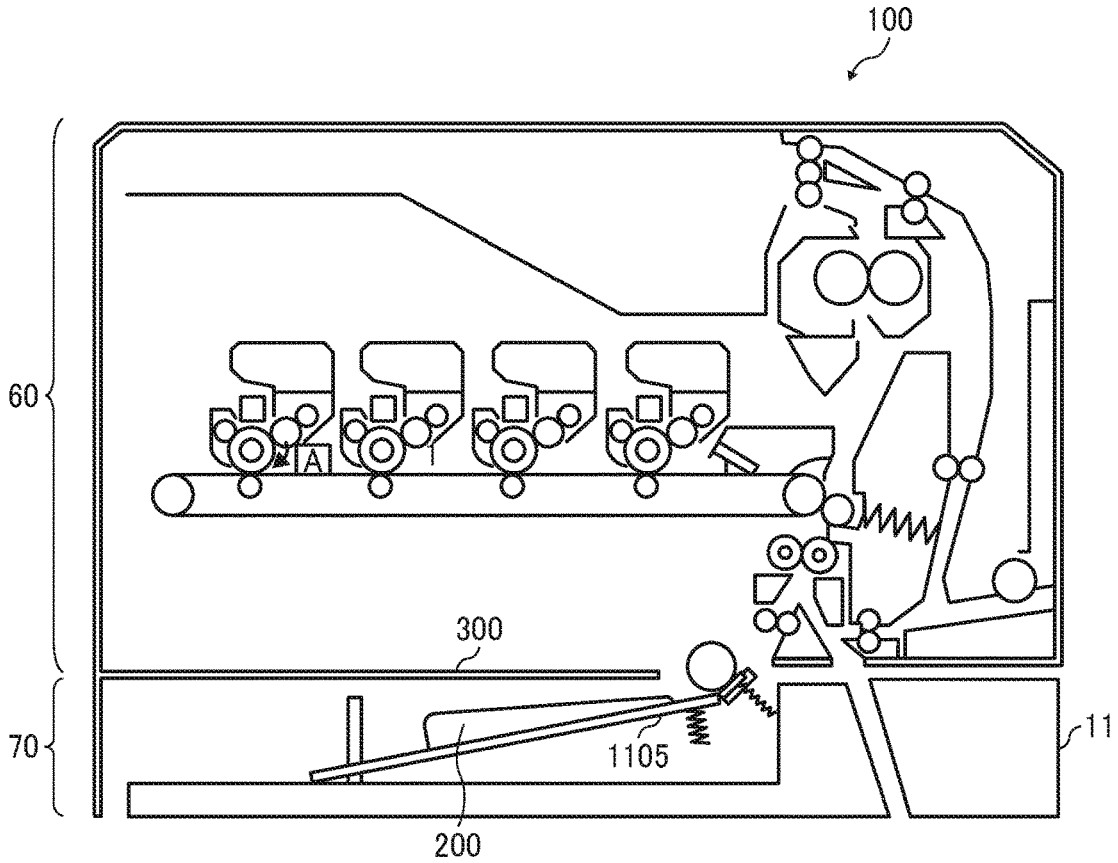
FIG. 12B is a diagram illustrating the image forming apparatus with the device attachment attached thereto.

FIGS. 12A and 12B are diagrams illustrating the sheet feed tray 11 with the device attachment 200 and the image forming apparatus 100 into which the sheet feed tray 11 inserted. FIG. 12A is a perspective view illustrating the sheet feed tray 11 with the device attachment 200 attached thereto.

FIG. 12B is a diagram illustrating the image forming apparatus 100 with the device attachment 200 attached thereto.

The device attachment 200 is detachably attachable to the bottom plate 1105 and is used while being attached to the bottom plate 1105 when feeding and conveying the envelope Pe with the flap fl. As illustrated in FIG. 11A, the device attachment 200 has an upstream side cut portion 201 and a downstream side cut portion 202. The upstream side cut portion 201 is to be located at the upstream side of the sheet conveying direction when the device attachment 200 is attached to the bottom plate 1105. Similarly, the downstream side cut portion 202 is to be located at the downstream side of the sheet conveying direction when the device attachment 200 is attached to the bottom plate 1105. The device attachment 200 further has a handle 203 and a hook opening 204. The device attachment 200 can be attached and detached easily with the handle 203. The hook opening 204 is provided to hook the device attachment 200 when the device attachment 200 is not used.

Positioning pins 205 and locking portions 206 are provided on the lower face side of the device attachment 200 on which the device attachment 200 is attached to the bottom plate 1105 illustrated in FIG. 11B.

As illustrated in FIG. 11C, the bottom plate 1105 has positioning holes 1105*b* at positions corresponding to the respective positioning pins 205 of the device attachment 200. The bottom plate 1105 further includes a gear clearance hole 1105*c* in order to avoid interference with a pinion gear, disposed on the lower face of the sheet tray housing 1100, of the side fences (i.e., the first side fence 1101 and the second side fence 1102) when the bottom plate 1105 is lowered. The locking portions 206 of the device attachment 200 are locked at an edge of the gear clearance hole 1105*c*. By so doing, the device attachment 200 can be attached to the bottom plate 1105.

When the sheet feed tray 11 with the device attachment 200 attached thereto is inserted into the image forming apparatus 100, the bottom plate 1105 with the device attachment 200 elevates along with rise of the link 1106, as illustrated in FIG. 12A. In this case, the upper face of the device attachment 200 functions as a loader face of the envelope(s) Pe. As illustrated in FIG. 12B, the sheet upper face guide plate 300 is disposed above the sheet feed tray 11 on the apparatus body side of the image forming apparatus 100. In FIGS. 12A and 12B, the upper face of the device attachment 200 acts as the loader face of the envelope(s) Pe.

Figure 13A:
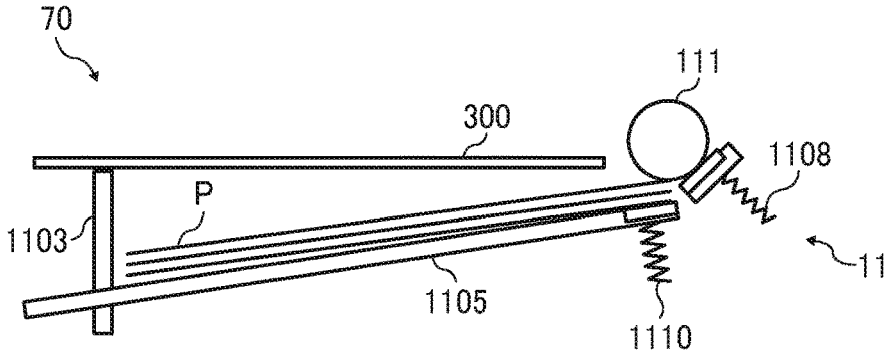
FIG. 13A is a diagram illustrating the sheet feeding device without the device attachment.
Figure 13B:
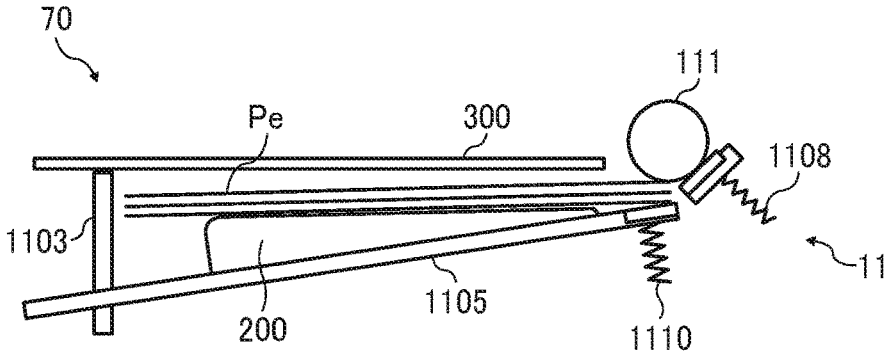
FIG. 13B is a diagram illustrating the sheet feeding device with the device attachment.
Figure 13C:
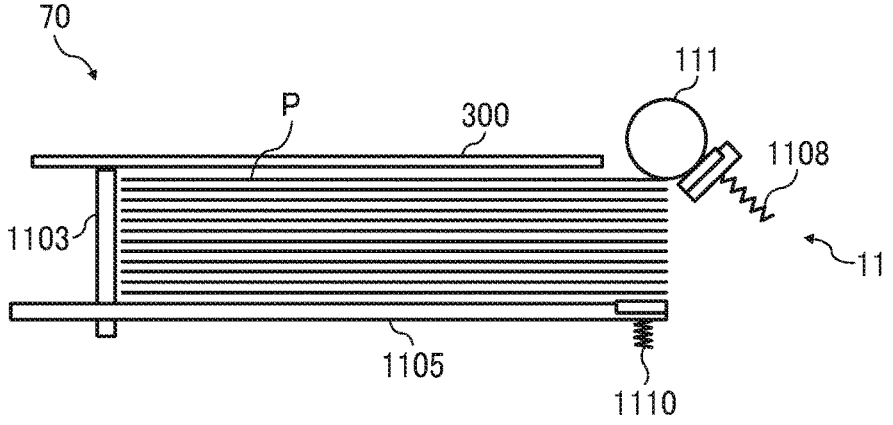
FIG. 13C is a diagram illustrating the sheet feeding device without the device attachment when loading a large number of sheets.

FIGS. 13A, 13B, and 13C are diagrams to explain different cases when the device attachment 200 is used or not. Specifically, FIG. 13A is a diagram illustrating the sheet feeding device 70 without the device attachment 200. FIG. 13B is a diagram illustrating the sheet feeding device 70 with the device attachment 200. FIG. 13C is a diagram illustrating the sheet feeding device 70 without the device attachment 200 when loading a large number of sheets.

When a regular sheet P such as a plain paper copy sheet is conveyed, the device attachment 200 is not used as illustrated in FIG. 13A. At this time, the bottom plate 1105 functions as a first loading portion that supports the sheet P at a first position.

When the envelope Pe with the flap fl is conveyed, the device attachment 200 is used as illustrated in FIG. 13B. At this time, the device attachment 200 attached to the bottom plate 1105 functions as a second loading portion that supports the envelope Pe at a second position.

Accordingly, whether the device attachment 200 is used or not is determined based on a sheet to be loaded on the bottom plate 1105. By so doing, a regular sheet such as the sheet P is used, the device attachment 200 is not used, and therefore a greater amount (number) of sheets can be loaded, as illustrated in FIG. 13C.

Figure 1B:
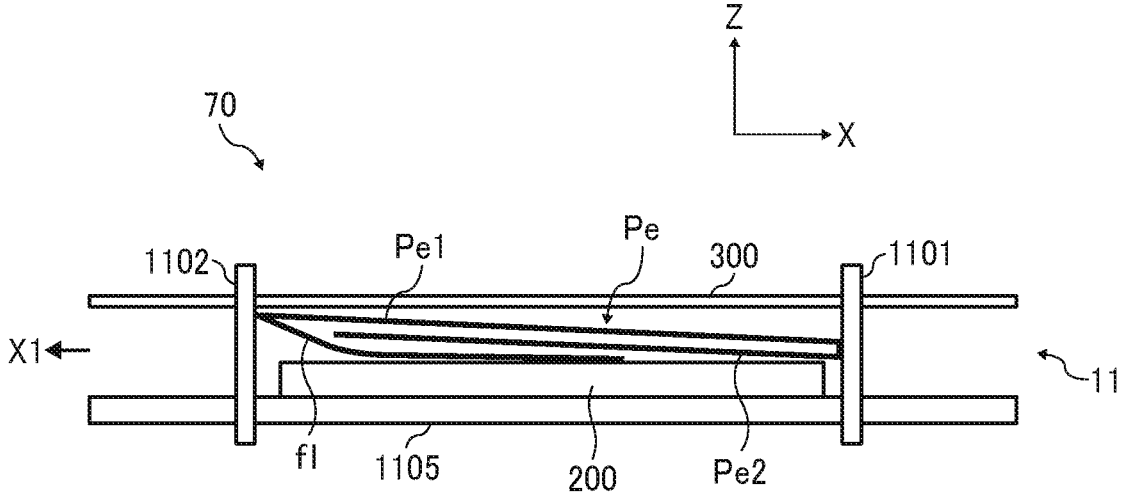
FIG. 1B is a cross sectional view illustrating the sheet feeding device viewed from a downstream side of a sheet conveying direction, along a line B'-B' of FIG. 1A.

FIGS. 1A and 1B are diagrams illustrating conveyance of the envelope Pe having the flap fl using the device attachment 200 in the sheet feeding device 70 according to an embodiment of this disclosure. Specifically, FIG. 1A is a diagram illustrating the sheet feeding device 70 according to the present embodiment of this disclosure, viewed from the X1 side of the sheet feeding device 70. FIG. 1B is a cross sectional view illustrating the sheet feeding device 70 viewed from the downstream side of the sheet conveying direction, along a line B'-B' of FIG. 1A.

As described above with reference to FIGS. 10A and 10B, the envelope Pe having the flap fl tends to rise at one end in the width direction when the envelope Pe is fed. In order to address this inconvenience, the sheet feeding device 70 according to the present embodiment has a configuration in which the envelope Pe that tends to rise contacts the sheet upper face guide plate 300. According to this configuration, the envelope Pe does not rise any further beyond the contact position with the sheet upper face guide plate 300. Consequently, generation of a gap between the second side fence 1102 and the one end of the envelope Pe in the width direction can be restrained. At this time, the lower face of the envelope Pe is supported by the device attachment 200 and an upper face of the envelope Pe contacts the sheet upper face guide plate 300.

As described above, contact of the sheet upper face guide plate 300 to the envelope Pe can prevent the envelope Pe from rising, and therefore the position of the envelope Pe at the end in the width direction can be regulated by the first side fence 1101 and the second side fence 1102. Consequently, skew (inclination) of the envelope Pe and diagonal folding of the flap fl can be prevented.

Further, as illustrated in FIG. 1A, a distance M from the upper face of the bottom plate 1105 that functions as a first loading portion to the envelope Pe supported by the upper face of the device attachment 200 that functions as a second loading portion is set to increase toward the upstream side of the sheet conveying direction indicated by arrow C in FIG. 1A. Due to this setting, even though the sheet feeding device 70 has the configuration in which the bottom plate 1105 inclines downwardly toward the upstream side of the sheet conveying direction when the envelope Pe is conveyed, the sheet upper face guide plate 300 contacts the envelope Pe over the entire length in the sheet conveying direction. Consequently, prevention of skew (inclination) of the envelope Pe and prevention of diagonal folding of the flap fl can be enhanced.

Figure 14:
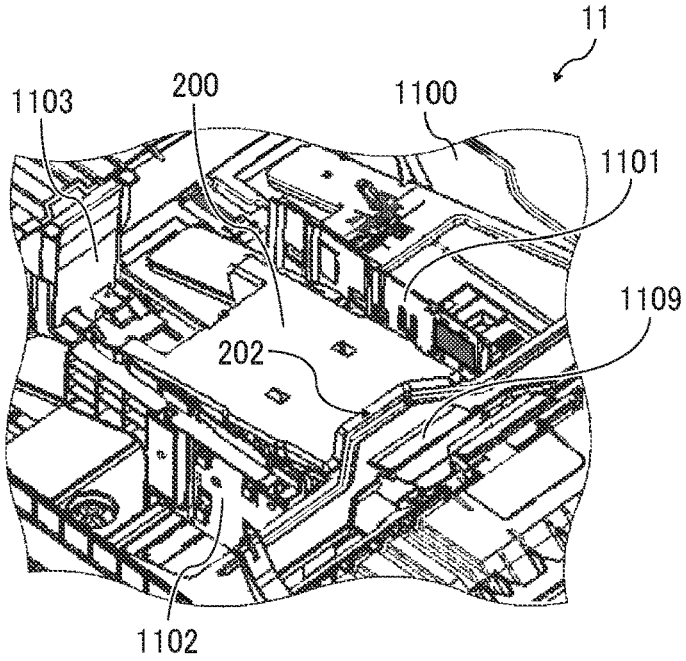
FIG. 14 is an enlarged perspective view illustrating the sheet feed tray with the device attachment and parts disposed in the vicinity of the device attachment.

FIG. 14 is an enlarged perspective view illustrating the sheet feed tray 11 with the device attachment 200 and parts disposed in the vicinity of the device attachment 200.

As described above with reference to FIGS. 11A, 11B, and 11C, the device attachment 200 includes the downstream side cut portion 202. Due to the configuration, as illustrated in FIG. 14, when the device attachment 200 is attached to the sheet feed tray 11, the sheet feed pad 1109 of the bottom plate 1105 can be exposed from the position of the downstream side cut portion 202.

Figure 15A:
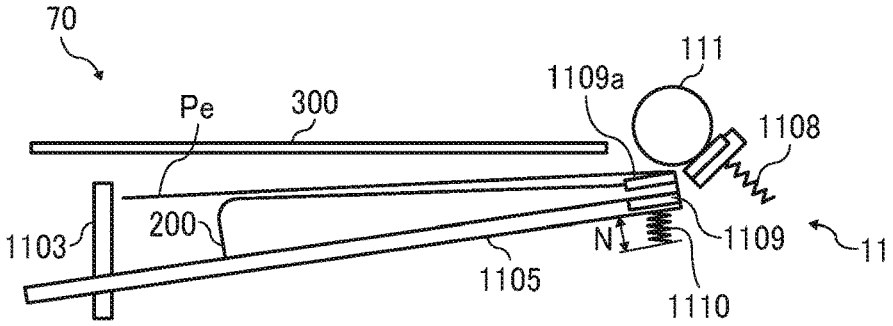
FIG. 15A is a diagram illustrating the device attachment without a downstream side cut portion.
Figure 15B:
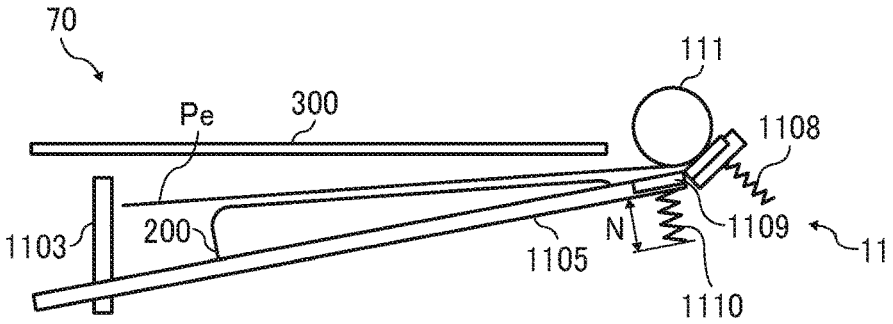
FIG. 15B is a diagram illustrating the device attachment with the downstream side cut portion.

FIGS. 15A and 15B are diagrams illustrating the device attachment 200 with or without the downstream side cut portion 202. Specifically, FIG. 15A is a diagram illustrating the device attachment 200 with a second sheet feed pad 1109*a* instead of the downstream side cut portion 202. FIG. 15B is a diagram illustrating the device attachment 200 with the downstream side cut portion 202 with the sheet feed pad 1109 of the bottom plate 1105 being exposed from the downstream side cut portion 202.

As illustrated in FIG. 15A, when the second sheet feed pad 1109*a* is provided to the device attachment 200, an effective length N of the sheet feed spring 1110 becomes shorter than the effective length N when the device attachment 200 is not attached to the bottom plate 1105 (for example, when a regular sheet is used). As the effective length N becomes smaller, the biasing force of the sheet feed spring 1110 increases, a force holding the sheet P between the second sheet feed pad 1109*a* and the sheet feed roller 111 increases, and therefore the conveying force in a sheet feed section increases. Even though the conveying force increases, the separation performance of the sheet P in the sheet separation section does not change. Therefore, when multiple sheets enter the sheet separation section, these sheets cannot be separated sufficiently, and therefore defects such as multi-feed can occur.

Even though the conveying force increases, the separation performance of the sheet P in the sheet separation section does not change. Therefore, when multiple sheets enter the sheet separation section, these sheets cannot be separated sufficiently, and therefore defects such as multi-feed can occur. Accordingly, the effective length N of the sheet feed spring 1110 does not change and stays the same even with or without the device attachment 200 to the bottom plate 1105, and therefore the biasing force of the sheet feed spring 1110 can also be the same with or without the device attachment 200. Since the same biasing force can be applied to press the sheet feed pad 1109 against the sheet P regardless of whether the device attachment 200 is provided to the bottom plate 1105 or not, the balance between the conveying force in the sheet feed section and the separation performance in the sheet separation section can be maintained. As a result, multi-feed of the sheets can be prevented when the device attachment 200 is provided.

Figure 16:
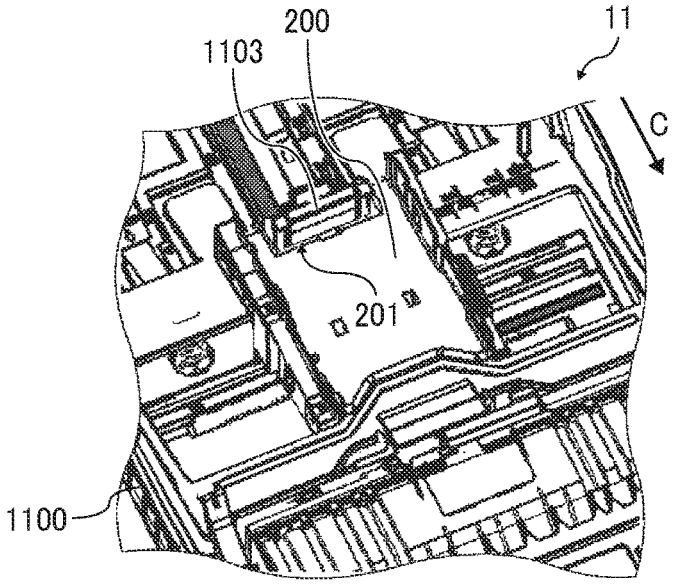
FIG. 16 is an enlarged perspective view illustrating the sheet feed tray with the device attachment and the parts disposed in the vicinity of the device attachment, viewed from a different angle from FIG. 14.

FIG. 16 is an enlarged perspective view illustrating the sheet feed tray 11 with the device attachment 200 and the parts disposed in the vicinity of the device attachment 200, viewed from a different angle from FIG. 14. As described above with reference to FIGS. 11A, 11B, and 11C, the device attachment 200 includes the upstream side cut portion 201. Due to the configuration, as illustrated in FIG. 16, when the device attachment 200 is attached to the sheet feed tray 11, the end fence 1103 can be moved to the downstream side of the sheet conveying direction from the upstream end of the device attachment 200. Accordingly, while the device attachment 200 is being attached, the end fence 1103 can regulate a smaller sheet having a length shorter in the sheet conveying direction than the sheet P described above.

Figure 17:
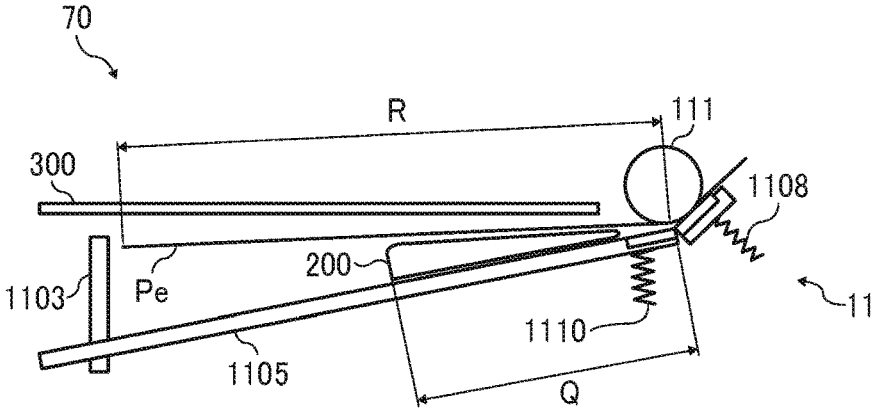
FIG. 17 is a diagram illustrating the device attachment without an upstream side cut portion.

FIG. 17 is a diagram illustrating the sheet feeding device 70 in which the device attachment 200 does not have the upstream side cut portion 201 and has a length equal to the length of the smaller sheet having the shorter length. Reference letter "Q" in FIG. 17 indicates a distance (hereinafter, referred to as the "distance Q") from the downstream side end of the bottom plate 1105 that functions as a first loading portion in the sheet conveying direction to the upstream side end of the device attachment 200 that functions as a second loading portion in the sheet conveying direction. Reference letter "R" in FIG. 17 indicates a length (hereinafter, referred to as the "length R") of the envelope Pe.

As illustrated in FIG. 17, when the length of the device attachment 200 in the sheet conveying direction is made smaller without the upstream side cut portion 201, a relation between the distance Q and the length R can be expressed with expression of $Q<R/2$. In this case, it is likely that the envelope Pe falls on the upstream side of the device attachment 200 in the sheet conveying direction. Specifically, in consideration of impact when the sheet feed tray 11 is inserted into the apparatus body of the image forming apparatus 100, it is desirable that the distance Q relative to the length R is set to be as great as possible. Regarding the value of the distance Q, it is desirable to set the value to be equal to the expression of $Q \geq R/2$. In other words, it is desirable to set that the distance Q is equal to or greater than a half of the length R.

By setting as described above, the envelope Pe can be supported at the position upstream from the center of gravity of the envelope Pe in the sheet conveying direction. Therefore, a positional shift or deviation of the envelope Pe can be prevented from impact being generated when the sheet feed tray 11 is inserted into the apparatus body of the image forming apparatus 100. Accordingly, misfeed of sheets P caused by deviation of the envelope Pe in the sheet feed tray 11 can be prevented.

In recent years, a sheet feeding device that can be included in an image forming apparatus is generally designed to process regular sheets such as PPC sheets and special sheets such as envelopes with each flap. Such a sheet feeding device generally includes a frictional separation mechanism to separate and convey sheets one by one. However, when a general frictional separation mechanism conveys an envelope having a flap, a load on the envelope can be different on the left side and the right side (the right and left deviation in the width direction) depending on the side on which the flap is provided and on the direction to which the flap faces, and therefore the envelope can easily incline (skew).

By contrast, the sheet feeding device 70 according to the present embodiment of this disclosure can prevent rise of the part of the sheet in the width direction by the sheet upper face guide plate 300 and can maintain regulation of the position of the sheet P in the width direction by the side fences (i.e., the first side fence 1101 and the second side fence 1102). Accordingly, even when the load to the sheet P is different on the left side and the right side, the position of the sheet P in the width direction can be regulated. Therefore, even when a special sheet such as the envelope Pe having the flap fl is conveyed, occurrence of skew (inclination) of the sheet P (i.e., the envelope Pe) can be restrained and prevented.

In the image forming apparatus 100, the sheet feeding device 70 can restrain occurrence of skew (inclination) of the sheet P, thereby preventing an image forming failure in which an image formed on a special sheet such as the envelope Pe with the flap fl is inclined, for example. In addition, occurrence of a sheet conveying failure caused by skew (inclination) of the sheet P can be prevented.

The lower face of the sheet upper face guide plate 300 to which a sheet such as the envelope Pe contacts has a smooth, flat shape or a shape having ribs so as to guide the sheet contact thereto in the sheet conveying direction. Consequently, the sheet contacting the sheet upper face guide plate 300 can be conveyed smoothly.

Variation 1.

Figure 18:
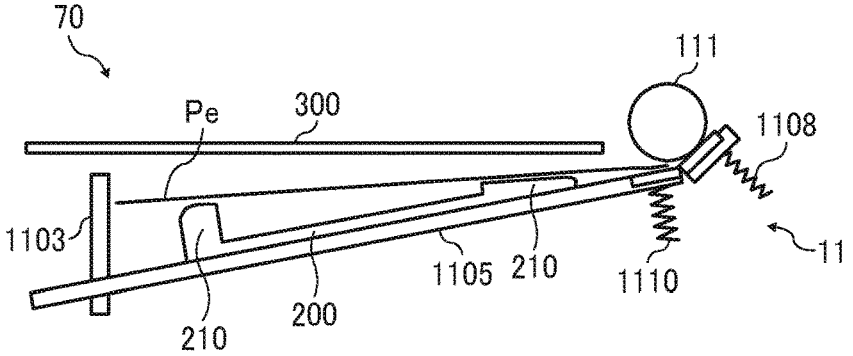
FIG. 18 is a diagram illustrating a schematic configuration of the sheet feeding device according to Variation 1.

FIG. 18 is a diagram illustrating a schematic configuration of the sheet feeding device 70 according to a variation. Hereinafter, the variation is referred to as "Variation 1".

As illustrated in FIG. 18, the sheet feeding device 70 according to Variation 1 includes the device attachment 200 supporting multiple supports 210 thereon while the sheet feeding device 70 of the above-described embodiment includes the device attachment 200 having a flat upper face.

As long as the position of the envelope Pe can stay flat (straight), as illustrated in FIG. 18, the device attachment 200 may have a configuration in which the multiple supports 210 support the envelope Pe. The device attachment 200 of Variation 1 is useful in a case in which the device attachment 200 partly interferes with parts disposed in the vicinity of the device attachment 200 due to elevation of the bottom plate 1105. However, in order to stabilize the position of the envelope Pe over the entire length in the sheet conveying direction, it is preferable that the device attachment 200 having the flat upper face supports the envelope Pe.

Variation 2.

Figure 19A:
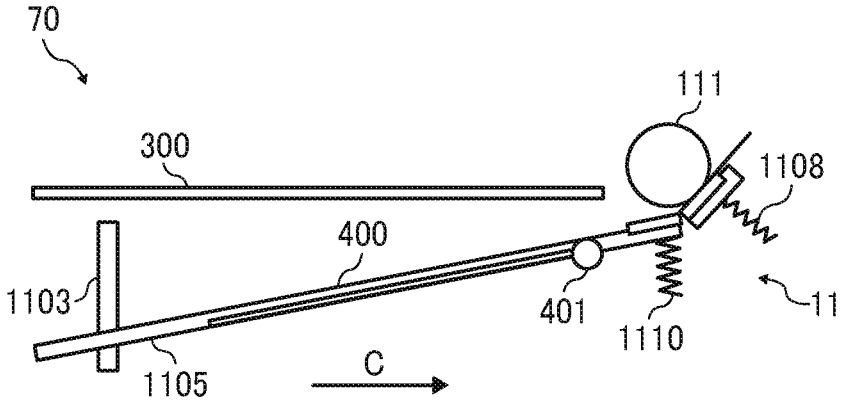
FIG. 19A is a diagram illustrating a schematic configuration of the sheet feeding device according to Variation 2 when feeding a paper sheet.
Figure 19B:
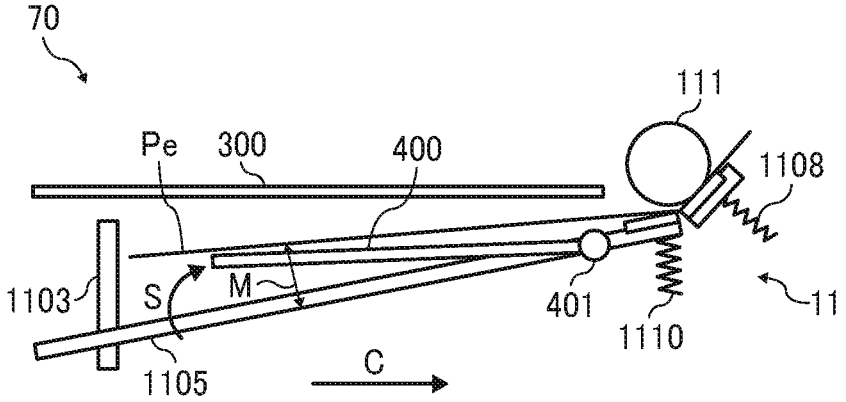
FIG. 19B is a diagram illustrating a schematic configuration of the sheet feeding device according to Variation 2 when feeding an envelope.

FIGS. 19A and 19B are diagrams illustrating schematic configurations of the sheet feeding device 70 according to Variation 2. Specifically, FIG. 19A is a diagram illustrating the sheet feeding device 70 according to Variation 2 when feeding a regular sheet. FIG. 19B is a diagram illustrating the sheet feeding device 70 according to Variation 2 when feeding an envelope, for example, the envelope Pe.

As illustrated in FIG. 19A, the sheet feed tray 11 of the sheet feeding device 70 of Variation 2 includes a compact bottom plate 400 provided to the bottom plate 1105 that functions as a first loading portion. The compact bottom plate 400 that functions as a rotatable body can rotate about a small bottom plate rotation pivot 401, as illustrated in FIG. 19A, and maintain a state in which an upstream side thereof in the sheet conveying direction stays lifted, as illustrated in FIG. 19B. In the sheet feeding device 70 of Variation 2, the compact bottom plate 400 rotates from the state of FIG. 19A in a direction indicated by arrow S as illustrated in FIG. 19B. Therefore, the compact bottom plate 400 functions as a second loading portion, as illustrated in FIG. 19B. Accordingly, this configuration of the sheet feeding device 70 of Variation 2 can achieve the same effect as the above-described sheet feeding device 70 having the device attachment 200.

When a regular sheet P such as a plain paper copy sheet is conveyed, the compact bottom plate 400 is not used, as illustrated in FIG. 19B. By so doing, similar to the configuration of the sheet feeding device 70 illustrated in FIG. 13C, when a regular sheet such as the sheet P is used, the device attachment 200 is not used, and therefore the volume (number) of sheets can be loaded. Further, since the sheet feeding device 70 of Variation 2 does not include the device attachment 200, a user do not worry about a place to store the device attachment 200 that is detached from the bottom plate 1105 when not being used.

Reference letter "M" in FIG. 19B indicates a distance (hereinafter, referred to as the "distance M") from the upper face of the bottom plate 1105 that functions as a first loading portion in the sheet conveying direction to the envelope Pe that is supported by the upper face of the compact bottom plate 400 that functions as a second loading portion in the sheet conveying direction. The distance M is set in the same manner as the configuration of FIG. 1A with the device attachment 200. Specifically, the distance M is set to increase toward the upstream side of the sheet conveying direction indicated by arrow C in FIG. 19B. Due to this setting, even though the sheet feeding device 70 of Variation 2 has the configuration in which the bottom plate 1105 inclines downwardly toward the upstream side of the sheet conveying direction when the envelope Pe is conveyed, the sheet upper face guide plate 300 contacts the envelope Pe over the entire length in the sheet conveying direction. Consequently, prevention of skew (inclination) of the envelope Pe and prevention of diagonal folding of the flap fl can be enhanced.

Variation 3.

Figure 20:
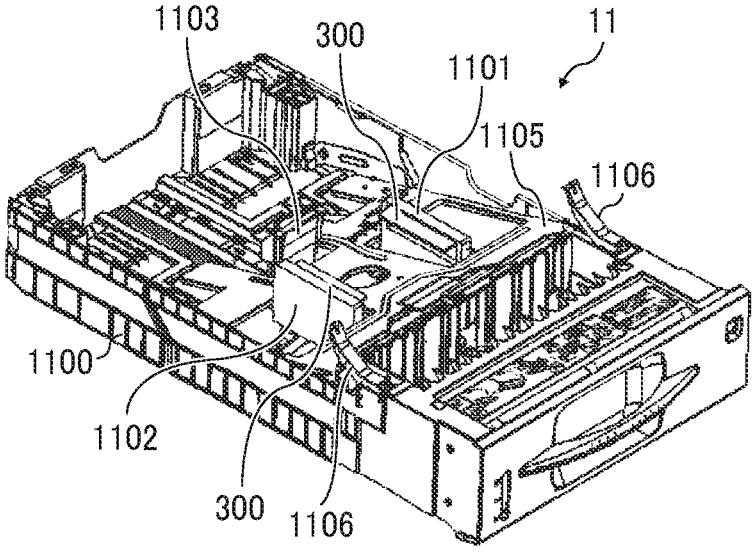
FIG. 20 is a diagram illustrating a perspective view illustrating of the sheet feed tray according to Variation 3.
Figure 21:
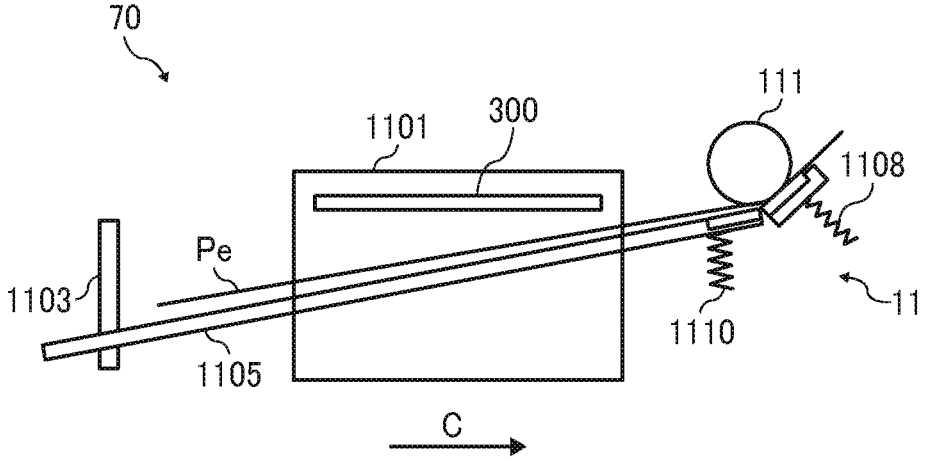
FIG. 21 is a diagram illustrating a schematic configuration of the sheet feeding device according to Variation 3.
Figure 22A:
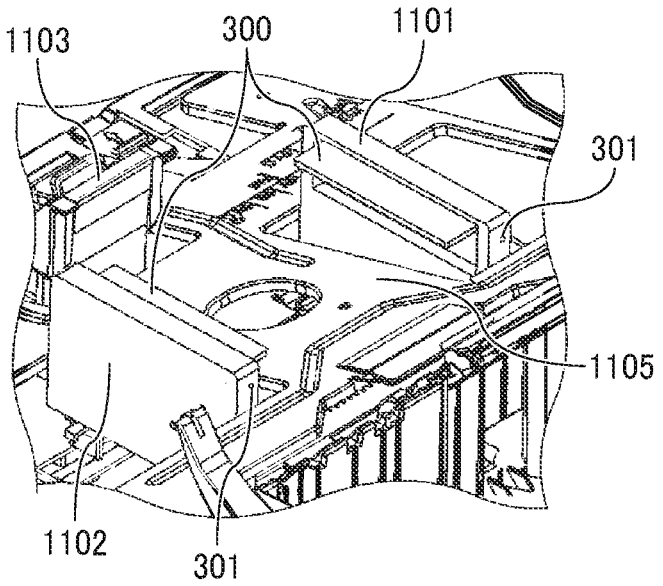
FIG. 22A is an enlarged view illustrating the bottom plate and two side fences of the sheet feed tray of Variation 3 with a sheet upper face guide plate.
Figure 22B:
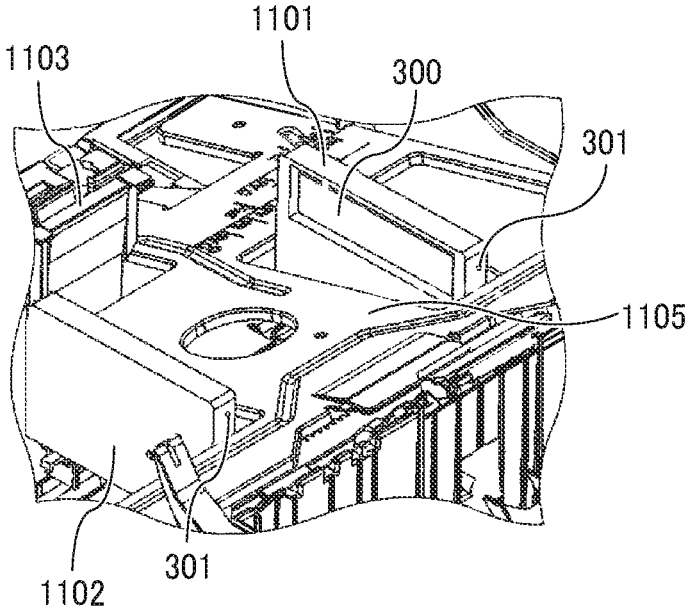
FIG. 22B is an enlarged view illustrating the bottom plate and the two side fences of the sheet feed tray of Variation 3 without the sheet upper face guide plate.

FIG. 20 is a diagram illustrating a perspective view illustrating of the sheet feed tray 11 according to Variation 3. FIG. 21 is a diagram illustrating a schematic configuration of the sheet feeding device 70 according to Variation 3. FIGS. 22A and 22B are diagrams illustrating schematic configurations of the sheet feeding device 70 according to Variation 3, in the vicinity of the bottom plate 1105 and the side fences (i.e., the first side fence 1101 and the second side fence 1102) of the sheet feed tray 11 of Variation 3. Specifically, FIG. 22A is an enlarged view illustrating the bottom plate 1105 of the sheet feed tray 11 when using the sheet upper face guide plates 300. FIG. 22B is an enlarged view illustrating the bottom plate 1105 of the sheet feed tray 11 when not using the sheet upper face guide plates 300.

As illustrated in FIGS. 20 through 22B, the sheet feeding device 70 of Variation 3 has a configuration in which the respective sheet upper face guide plates 300 are provided to the first side fence 1101 and the second side fence 1102. Similar to the sheet feeding device 70 of Variation 2, since the sheet feeding device 70 of Variation 3 does not include the device attachment 200, a user do not worry about a place to store the device attachment 200 that is detached from the bottom plate 1105 when not being used.

The sheet upper face guide plates 300 of Variation 3 include respective guide plate pivots 301. The sheet upper face guide plates 300 are attached to the side fences (i.e., the first side fence 1101 and the second side fence 1102) so that each of the sheet upper face guide plates 300 rotates about the corresponding guide plate pivot 301. Therefore, when not being used, each of the sheet upper face guide plates 300 is rotated about the guide plate pivot 301 from the state of FIG. 22A, so that the sheet upper face guide plates 300 are retreated, as illustrated in FIG. 22B. By so doing, when a regular sheet such as the sheet P (for example, a PPC sheet) is used, a greater amount (number) of sheets can be loaded.

Variation 4.

Figure 23:
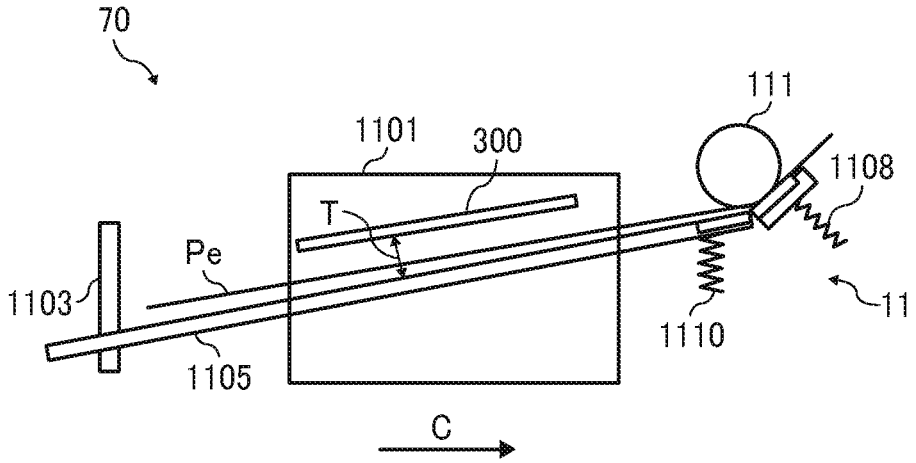
FIG. 23 is a diagram illustrating a schematic configuration of the sheet feeding device according to Variation 4.
Figure 24A:
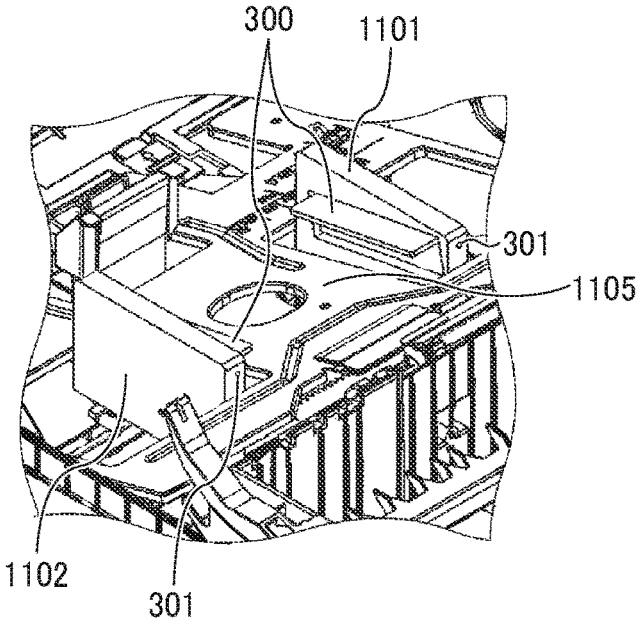
FIG. 24A is an enlarged view illustrating the bottom plate and two side fences of the sheet feed tray of Variation 4 with the sheet upper face guide plate.
Figure 24B:
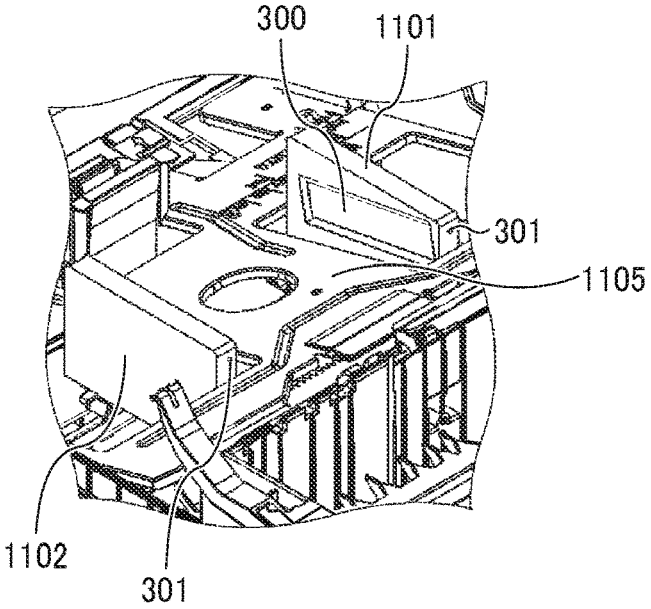
FIG. 24B is an enlarged view illustrating the bottom plate and the two side fences of the sheet feed tray of Variation 4 without the sheet upper face guide plate.

FIG. 23 is a diagram illustrating a schematic configuration of the sheet feeding device 70 according to yet another variation. Hereinafter, this variation is referred to as "Variation 4". FIGS. 24A and 24B are enlarged diagrams illustrating schematic configurations of the sheet feeding device 70 according to Variation 4, in the vicinity of the bottom plate 1105 and the side fences (i.e., the first side fence 1101 and the second side fence 1102) of the sheet feed tray 11 of Variation 4. Specifically, FIG. 24A is an enlarged view illustrating the bottom plate 1105, the first side fence 1101, and the second side fence 1102 of the sheet feed tray 11 of Variation 4 with the sheet upper face guide plate 300. FIG. 24B is an enlarged view illustrating the bottom plate 1105, the first side fence 1101, and the second side fence 1102 of the sheet feed tray 11 of Variation 4 without the sheet upper face guide plate 300.

The sheet feeding device 70 of Variation 4 has a configuration basically identical to the sheet feeding device 70 of Variation 3, except that, different from the configuration of the sheet feeding device 70 of Variation 3, the sheet feeding device 70 of Variation 4 has the configuration in which the sheet upper face guide plate 300 to be used is lowered toward the upstream side of the sheet conveying direction.

By disposing the sheet upper face guide plate 300 with an angle according to the configuration of Variation 4, a distance T between the envelope Pe and the sheet upper face guide plate 300 can be regulated over the entire length of the envelope Pe in the sheet conveying direction. Due to this setting, the sheet upper face guide plate 300 contacts the envelope Pe over the entire length in the sheet conveying direction, and therefore prevention of skew (inclination) of the envelope Pe and prevention of diagonal folding of the flap fl can be enhanced.

Variation 5.

Figure 25A:
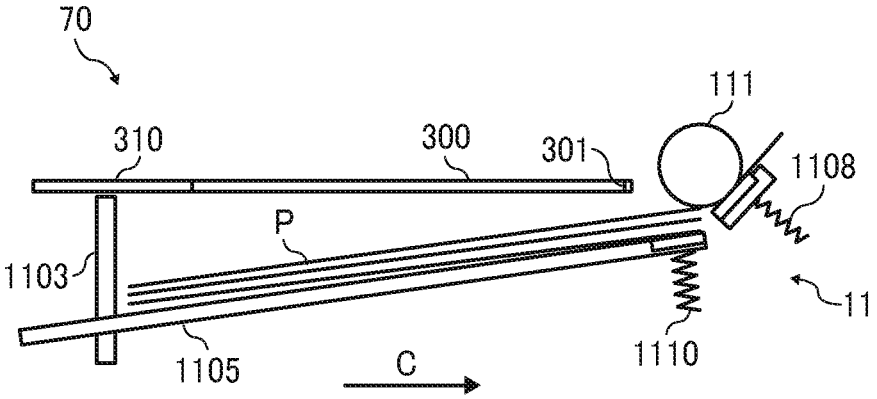
FIG. 25A is a diagram illustrating a schematic configuration of the sheet feeding device according to Variation 5 with the sheet upper face guide plate.
Figure 25B:
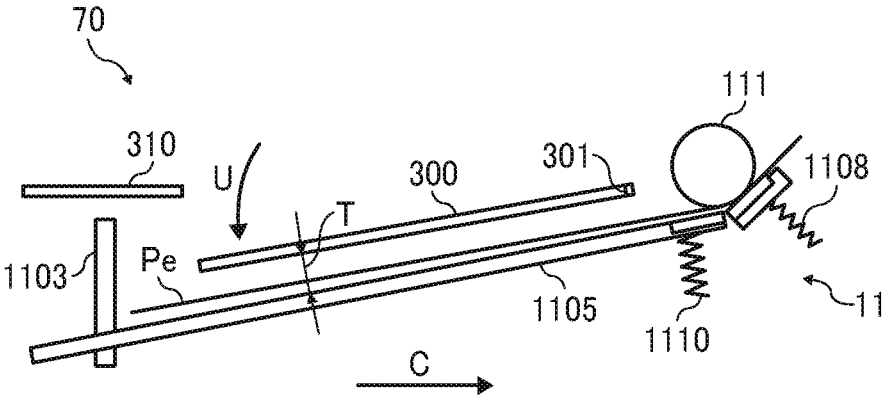
FIG. 25B is an enlarged view illustrating the bottom plate and two side fences of the sheet feed tray of Variation 5 without the sheet upper face guide plate.

FIGS. 25A and 25B are diagrams illustrating schematic configurations of the sheet feeding device 70 according to yet another variation. Hereinafter, this variation is referred to as "Variation 5". Specifically, FIG. 25A is a diagram illustrating a schematic configuration of the sheet feeding device 70 according to Variation 5, without the sheet upper face guide plate 300. FIG. 25B is an enlarged view illustrating a schematic configuration of the sheet feeding device 70 according to Variation 5, with the sheet upper face guide plate 300.

The sheet feeding device 70 of Variation 5 includes a sheet feed ceiling plate 310 that forms a ceiling of the sheet feed tray 11. The sheet upper face guide plate 300 is rotatable about the guide plate pivot 301 and is supported to the sheet feed ceiling plate 310.

In a case in which the envelope Pe with the flap fl is conveyed, after the sheet feed tray 11 has been inserted into the apparatus body of the image forming apparatus 100, the sheet upper face guide plate 300 is rotated in a direction indicated by arrow U illustrated in FIG. 25B so as to move to a position along the inclined bottom plate 1105. By disposing the sheet upper face guide plate 300 along the bottom plate 1105, the distance T between the envelope Pe and the sheet upper face guide plate 300 can be regulated over the entire length of the envelope Pe in the sheet conveying direction. Due to this setting, the sheet upper face guide plate 300 contacts the envelope Pe over the entire length in the sheet conveying direction, and therefore prevention of skew (inclination) of the envelope Pe and prevention of diagonal folding of the flap fl can be enhanced.

In a case in which the sheet upper face guide plate 300 is not used, after the sheet feed tray 11 has been inserted into the apparatus body of the image forming apparatus 100, the envelope Pe is conveyed without moving the sheet upper face guide plate 300 as illustrated in FIG. 25B. By so doing, when a regular sheet such as the sheet P (for example, a PPC sheet) is used, a greater amount (number) of sheets can be loaded.

Variation 6.

Figure 26A:
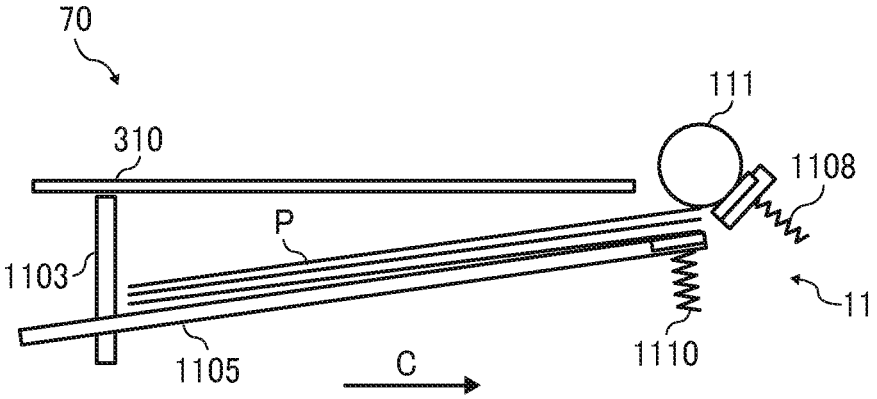
FIG. 26A is a diagram illustrating a schematic configuration of the sheet feeding device according to Variation 6 without an upper face guide attachment.
Figure 26B:
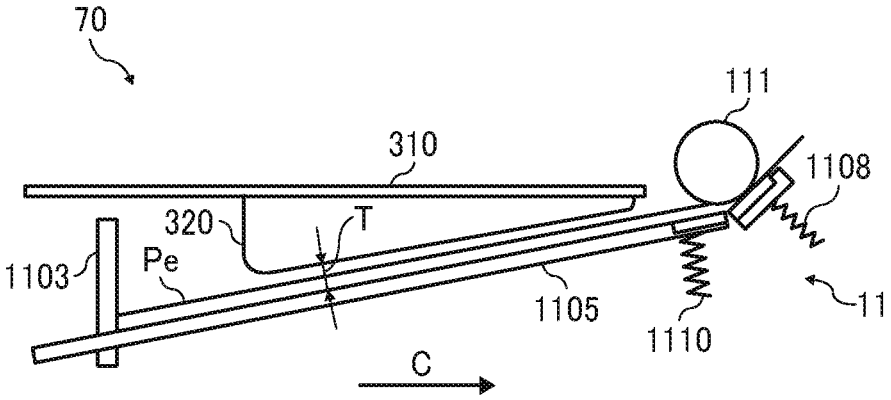
FIG. 26B is an enlarged view illustrating the bottom plate and two side fences of the sheet feed tray of Variation 6 with the upper face guide attachment.

FIGS. 26A and 26B are diagrams illustrating schematic configurations of the sheet feeding device 70 according to yet another variation. Hereinafter, this variation is referred to as "Variation 6". The sheet feeding device 70 of Variation 6 has a configuration basically identical to the sheet feeding device 70 of Variation 5, except that, different from the configuration of the sheet feeding device 70 of Variation 5 having the sheet upper face guide plate 300, the sheet feeding device 70 of Variation 6 has an upper face guide attachment 320 that is detachably attached to the sheet feed ceiling plate 310.

Specifically, FIG. 26A is a diagram illustrating a schematic configuration of the sheet feeding device 70 according to Variation 6 without the upper face guide attachment 320. FIG. 26B is an enlarged view illustrating a schematic configuration of the sheet feeding device 70 according to Variation 6 with the upper face guide attachment 320.

In a case in which the envelope Pe with the flap fl is conveyed, before or after the sheet feed tray 11 has been inserted into the apparatus body of the image forming apparatus 100, the upper face guide attachment 320 is attached to the sheet feed ceiling plate 310. By disposing the upper face guide attachment 320 such that a lower face of the upper face guide attachment 320 is located along the inclined bottom plate 1105, the distance T between the envelope Pe and the upper face guide attachment 320 can be regulated over the entire length of the envelope Pe in the sheet conveying direction. Due to this setting, the upper face guide attachment 320 contacts the envelope Pe over the entire length in the sheet conveying direction, and therefore prevention of skew (inclination) of the envelope Pe and prevention of diagonal folding of the flap fl can be enhanced.

In a case in which the upper face guide attachment 320 is not used, after the sheet feed tray 11 has been inserted into the apparatus body of the image forming apparatus 100, the envelope Pe is conveyed without moving the upper face guide attachment 320 as illustrated in FIG. 26B. By so doing, when a regular sheet such as the sheet P (for example, a PPC sheet) is used, a greater amount (number) of sheets can be loaded.

As described above, the sheet feeding device 70 according to the present embodiment conveys a sheet such as the sheet P and the envelope Pe. However, a sheet that is fed and conveyed by the sheet feeding device according to this disclosure is not limited thereto but includes plain paper, coated paper, label paper, OHP sheet and film, and the like.

In the sheet feeding device 70 according to the present embodiment of this disclosure, a distance of closest approach between the sheet upper face guide plate 300 and the upper face of the envelope Pe that is located at a position to which a conveying force is applied by the sheet feed roller 111 is preferably set narrower or smaller than the width of the flap fl of the envelope Pe settable on the sheet feed tray 11. By so doing, the envelope Pe that is being elevated contacts the sheet upper face guide plate 300, so that rise of the envelope Pe beyond the contact position can be prevented. Therefore, conveyance of a skewed (inclined) envelope Pe due to the rise of the envelope Pe can be restrained.

The configurations according to the above-descried embodiments are not limited thereto. This disclosure can achieve the following aspects effectively.

Aspect A.

In Aspect A, a sheet feeding device (for example, the sheet feeding device 70) includes a sheet container (for example, the sheet feed tray 11), a support (for example, the bottom plate 1105 or the device attachment 200), a sheet width regulator (for example, the first side fence 1101 and the second side fence 1102), a conveying force applier (for example, the sheet feed roller 111), and a sheet guide (for example, the sheet upper face guide plate 300). The sheet container is configured to accommodate a sheet (for example, the envelope Pe). The support is configured to support a lower face of the sheet in the sheet container. The sheet width regulator is configured to regulate a position of the sheet in a sheet width direction. The conveying force applier is configured to apply a sheet conveying force in a sheet conveying direction to the sheet in the sheet container. The sheet guide is disposed above the sheet in the sheet container and is configured to regulate movement of the sheet in an upper direction.

As a result of intensive studies, when, a sheet is skewed (inclined) due to the following reasons have been found as a cause of skew (inclination) of an envelope when the envelope having a flap is fed and conveyed.

It is to be noted that a "back face" is on which a flap is provided to an envelope and a "front face" is on which no flap is provided. Generally, such the front face and the back face of such an envelope other than the flap are joined by sealing and folding at three line edges of four line edges that form an external form of the envelope and a line edge other than the three line edges of the four line edges is not joined.

The other line edge other than the three edges of the four line edges of the envelope forms an opening of the envelope. The flap is joined with the front face of the envelope. By folding the other line edge on the front face of the envelope toward the back face of the envelope, the opening of the envelope is closed.

Next, the envelope is placed on the sheet container with the back face of the envelope facing down such that the other line edge that is folded as a joint of the flap and the front face of the envelope is disposed parallel to the sheet conveying direction. In this case, the envelope is conveyed as follows. As the conveyance of the envelope starts, the conveying force applier applies the conveying force to the front face of the envelope toward the sheet conveying direction. At the same time, a separator inhibits the back face of the envelope from moving in the sheet conveying direction. Due to the joint with the front face at the three line edges of the four line edges, the back face of the envelope other than the flap is not separated but the flap that is joined with the front face at the fold on the other line edge other than the three line edges is about to be separated. In a case in which such conveyance of the envelope is continued, the flap is continuously about to be separated from the front face of the envelope, and therefore, the back face of the envelope other than the flap is conveyed to the downstream side of the sheet conveying direction and the flap alone remains at the upstream side of the sheet conveying direction. Since an amount of movement of the front face of the envelope in the sheet conveying direction does not match with an amount of movement of the flap of the envelope in the sheet conveying direction, the front face of the envelope and the flap of the envelope are twisted, and therefore the fold joining the front face of the envelope and the flap are joint becomes swollen.

Consequently, the other line edge at the fold of the flap of the envelope in the width direction and the front face of the envelope rises, and the envelope becomes inclined. In this condition, the gap is formed between the sheet width regulator and the one end of the envelope in the width direction, and therefore the sheet width regulator cannot regulate the position of the envelope in the width direction. When a force to rotate the envelope is applied in this state for some reason, the sheet width regulator cannot stop the rotation, and therefore the envelope is conveyed in a skewed (inclined) state. Such conveyance of an envelope in the skewed (inclined) state occurs not only when a sheet to be conveyed is an envelope with a flap but also when one end of an envelope rises during conveyance to skew (incline). The conveyance of a skewed (inclined) envelope or sheet easily occurs not only when the separator inhibits movement of the envelope in the sheet conveying direction. Such conveyance also occurs in a case in which the sheet width regulator cannot regulate the position of the envelope or sheet in the width direction due to rise of part of the sheet or envelope in the width direction during the conveyance.

In Aspect A, the sheet guide regulates movement of the sheet in the upward direction, and therefore rise of part of the sheet in the width direction during the conveyance of the sheet can be prevented and regulation of the position of the sheet in the width direction can be maintained by the sheet width regulator. Accordingly, in a case in which a special sheet such as an envelope with a flap is conveyed, occurrence of skew (inclination) of the sheet during conveyance of the sheet is conveyed can be restrained.

Aspect B.

In Aspect A, the sheet guide (for example, the sheet upper face guide plate 300) regulates the movement of the sheet (for example, the envelope Pe) in the upper direction at an upstream side of the sheet conveying direction relative to a position at which the conveying force applier (for example, the sheet feed roller 111) applies a conveying force to the sheet.

According to this configuration, as described in the embodiment above, elevation of part of the sheet in the width direction such as the rise of the flap fl at the upstream side from the sheet feeding position is prevented, and therefore occurrence of skew (inclination) of the sheet due to the rise of the sheet can be restrained.

Aspect C.

In Aspect A or Aspect B, a lower face of the sheet guide (for example, the sheet upper face guide plate 300 and e has a shape to guide the sheet in contact therewith to the sheet conveying direction.

According to this configuration, as described in the above-described embodiment, the sheet that contacts the lower face of the sheet guide can be conveyed smoothly.

Aspect D.

In any one of Aspect A through Aspect C, the sheet feeding device (for example, the sheet feeding device 70) further includes a separator (for example, the separation pad 1104) configured to prevent a subsequent sheet other than the sheet to which the conveying force applier (for example, the sheet feed roller 111) applies the sheet conveying force, from moving in the sheet conveying direction and to separate the subsequent sheet from the sheet.

According to this configuration, as described in the above-described embodiment, even when the force to rotate the sheet by the conveying force applier and the separator, the sheet width regulator can maintain regulation of the position of the sheet in the width direction. Accordingly, occurrence of conveyance of a skewed (inclined) sheet can be prevented.

Aspect E.

In any one of Aspect A through Aspect D, the support (for example, the bottom plate 1105 or the device attachment 200) includes a sheet loader (for example, the bottom plate 1105) and a device attachment body (for example, the device attachment 200). The sheet loader includes a first loading portion (for example, the bottom plate 1105) configured to support the sheet at a first position. The device attachment body includes a second loading portion (for example, the device attachment 200) disposed detachably attachable to the sheet loader and configured to support the sheet at a second position.

According to this configuration, as described in the above-described embodiment, by providing the device attachment body, prevention of skew (inclination) of the sheet can be enhanced. Further, an operator such as a user selectively detaches the device attachment body from the sheet container (for example, the sheet feed tray 11), a greater amount (number) of sheet can be loaded on the sheet container. By so doing, when a regular sheet such as the sheet P (for example, a PPC sheet) other than a special sheet is used, the operator (the user) can select and determine the amount (number) of sheets to be loaded on the sheet container.

Aspect F.

In Aspect E, the device attachment body (for example, the device attachment 200) has a shape such that a distance (for example, the distance M) from a loading face of the sheet loader (for example, the bottom plate 1105) to the sheet (for example, the envelope Pe) loaded on a loading face of the device attachment body with the device attachment body attached to the sheet loader increases toward an upstream side of the sheet conveying direction.

According to this configuration, as described in the above-described embodiment, the sheet guide (for example, the sheet upper face guide plate 300) contacts the sheet (for example, the envelope Pe) over the entire length in the sheet conveying direction. Accordingly, prevention of skew (inclination) of the sheet can be enhanced.

Aspect G.

In Aspect E or Aspect F, the sheet loader (for example, the bottom plate 1105) includes a friction body (for example, the sheet feed pad 1109) disposed facing the conveying force applier (for example, the sheet feed roller 111) and configured to hold the sheet (for example, the envelope Pe) together with the conveying force applier. The friction body is exposed in a state in which the device attachment body (for example, the device attachment 200) is attached to the sheet loader.

According to this configuration, as described in the above-described embodiment, since the same biasing force is applied to press the friction body against the sheet regardless of whether the device attachment body is provided to the sheet loader or not, the balance between the conveying force in the sheet feed section and the separation performance in the sheet separation section can be maintained. As a result, occurrence of multi-feed of the sheets can be prevented.

Aspect H.

In any one of Aspect E through Aspect G, the second loading portion (for example, the upper face of the device attachment 200) of the device attachment body (for example, the device attachment 200) includes an inclined flat loading face inclined relative to a loading face of the first loading portion (for example, the upper face of the bottom plate 1105) of the sheet loader (for example, the upper face of the bottom plate 1105).

According to this configuration, as described in the above-described embodiment, by supporting the sheet (for example, the envelope Pe) on the flat loading face of the sheet loader, the position of the sheet can be stabilized over the entire length of the sheet in the sheet conveying direction. Consequently, the sheet can be conveyed stably.

Aspect I.

In any one of Aspect E through Aspect H, the device attachment body (for example, the device attachment 200) is set such that a distance (for example, the distance Q) from a downstream end of the first loading portion (for example, the upper face of the bottom plate 1105) in the sheet conveying direction to an upstream end of the second loading portion (for example, the upper face of the device attachment 200) in the sheet conveying direction is equal to or greater than a half of a distance (for example, the distance R) of the sheet (for example, the envelope Pe) loadable on the sheet loader (for example, the upper face of the bottom plate 1105).

According to this configuration, as described in the above-described embodiment, misfeed of the sheet caused by the positional shift or deviation of the sheet in the sheet container (for example, the sheet feed tray 11) can be prevented.

Aspect J.

In any one of Aspect E through Aspect I, the device attachment body (for example, the device attachment 200) includes a cut portion (for example, the upstream side cut portion 201) at an upstream end thereof in the sheet conveying direction.

According to this configuration, as described in the above-described embodiment, a sheet end regulator (for example, the end fence 1103) that regulates an upstream side end of the sheet (for example, the envelope Pe) in the sheet conveying direction can be moved to the downstream side of the sheet conveying direction, than the upstream side end of the second loading portion (for example, the upper face of the device attachment 200). Accordingly, even when the device attachment body is attached, the position of the upstream side end of a small size sheet in the sheet conveying direction can be regulated, and therefore occurrence of misfeed of the small size sheet can be restrained and prevented.

Aspect K.

In any one of Aspect A through Aspect D, the support includes a sheet loader (for example, the bottom plate 1105) and a rotatable body (for example, the compact bottom plate 400). The sheet loader includes a first loading portion (for example, the bottom plate 1105) configured to support the sheet (for example, the envelope Pe) at a first position (for example, the position illustrated in FIG. 19A). The rotatable body includes a second loading portion (for example, the compact bottom plate 400) rotatably disposed to the sheet loader and configured to support the sheet at a second position (for example, the position illustrated in FIG. 19B).

According to this configuration, as described in Variation 2, by rotating the rotatable body to the second position at which the rotatable body supports the sheet, prevention of skew (inclination) of the sheet can be enhanced. Further, an operator such as a user selectively rotates the rotatable body, a greater amount (number) of sheet can be loaded on the sheet container (for example, the sheet feed tray 11). By so doing, when a regular sheet such as the sheet P (for example, a PPC sheet) other than a special sheet is used, the operator (the user) can select and determine the amount (number) of sheets to be loaded on the sheet container. Further, since this configuration does not include the device attachment body, the operator (the user) may not worry about a place to store the device attachment body that is detached from the sheet loader when not being used.

Aspect L.

In Aspect K, while the rotatable body (for example, the compact bottom plate 400) is supporting the sheet (for example, the envelope Pe) at the second position (for example, the position illustrated in FIG. 19B), a distance (for example, the distance M) from a loading face of the sheet loader (for example, the bottom plate 1105) to the sheet supported by the rotatable body increases toward an upstream side of the sheet conveying direction.

According to this configuration, as described in Variation 2, the sheet guide (for example, the sheet upper face guide plate 300) contacts the sheet (for example, the envelope Pe) over the entire length of the sheet in the sheet conveying direction. Accordingly, prevention of skew (inclination) of the sheet can be enhanced.

Aspect M.

In any one of Aspect A through Aspect D, the sheet guide (for example, the sheet upper face guide plate 300) is mounted on the sheet width regulator (for example, the first side fence 1101 and the second side fence 1102).

According to this configuration, as described in Variation 3, movement in the upper direction of the sheet (for example, the envelope Pe) that is conveyed by the sheet guide mounted on the sheet width regulator can be regulated. With this configuration, rise of part of the sheet in the width direction during conveyance of the sheet can be prevented, and regulation of the position of the sheet in the width direction by the sheet width regulator can be maintained. Accordingly, in a case in which a special sheet such as an envelope with a flap is conveyed, occurrence of skew (inclination) of the sheet during conveyance of the sheet is conveyed can be restrained. Further, the operator (the user) may not worry about a place to store the device attachment body.

Aspect N.

An image forming apparatus (for example, the image forming apparatus 100) includes an image forming device (for example, the image forming device 60) configured to form an image on a sheet (for example, the envelope Pe and the sheet P) and a sheet feeding device (for example, the sheet feeding device 70) configured to convey the sheet to the image forming device. The sheet feeding device includes the sheet feeding device according to any one of Aspect A through Aspect M.

According to this configuration, as described in the embodiment above, since occurrence of conveyance of the skewed (inclined) sheet can be restrained, an image forming failure in which a skewed (inclined) image is formed on a special sheet (for example, the envelope Pe with the flap fl) can be prevented.

Aspect O.

A device attachment body (for example, the device attachment 200) includes at least one cut portion (for example, the upstream side cut portion 201). The device attachment body is configured to be attached to the support (for example, the bottom plate 1105 or the device attachment 200) configured to support the lower face of the sheet container of the sheet feeding device. The device attachment body includes the device attachment body according to any one of Aspect E through Aspect J to be provided to the sheet feeding device (for example, the sheet feeding device 70).

According to this configuration, as described in the above-described embodiment, by providing the device attachment body to the support of the sheet feeding device, prevention of skew (inclination) of the sheet can be enhanced. Further, an operator such as a user selectively detaches the device attachment body of Aspect O from the sheet feeding device, a greater amount (number) of sheets can be loaded on the sheet container (for example, the sheet feed tray 11). By so doing, when a regular sheet such as the sheet P (for example, a PPC sheet) other than a special sheet is used, the operator (the user) can select and determine the amount (number) of sheets to be loaded on the sheet container.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus, comprising:

a sheet feed tray including a housing configured to accommodate a flap envelope as a sheet and a side fence configured to regulate a position of the flap envelope in a width direction of the flap envelope;

a sheet feed roller configured to feed the flap envelope; and a sheet guide above the flap envelope and configured to regulate movement of the flap envelope in an upper direction, wherein the sheet feed tray is detachably attachable to an apparatus body of the image forming apparatus while leaving the sheet guide in the apparatus body of the image forming apparatus, wherein the flap envelope is inclined in the width direction when the housing accommodates the flap envelope.

2. The image forming apparatus according to claim 1, wherein a fold of a flap of the flap envelope extends along a sheet conveying direction when the housing accommodates the flap envelope.

3. The image forming apparatus according to claim 1, wherein a fold of a flap of the flap envelope extends along the side fence when the housing accommodates the flap envelope.

4. The image forming apparatus according to claim 1, wherein the sheet guide regulates the movement of the flap envelope in the upper direction at an upstream side of a sheet conveying direction relative to a position at which the sheet feed roller feeds the sheet.

5. The image forming apparatus according to claim 4, wherein a lower face of the sheet guide has a shape to guide the flap envelope in contact therewith to the sheet conveying direction.

6. The image forming apparatus according to claim 1, wherein a lower face of the sheet guide has a shape to guide the sheet in contact therewith to a sheet conveying direction.

7. The image forming apparatus according to claim 1, wherein the sheet guide is rotatably supported by the apparatus body of the image forming apparatus.

8. The image forming apparatus according to claim 1, wherein the sheet feed tray is detachably attachable to the apparatus body of the image forming apparatus while leaving the sheet feed roller in the apparatus body of the image forming apparatus.

9. The image forming apparatus according to claim 1, further comprising an image forming device configured to form an image on the flap envelope fed by the sheet feed roller.

10. An image forming apparatus, comprising:

a sheet feed tray including a housing configured to accommodate a flap envelope as a sheet and a side fence configured to regulate a position of the flap ennvelope in a width direction of the flap envelope;

a sheet feed roller configured to feed the flap envelope;

a sheet guide above the flap envelope and configured to regulate movement of the flap envelope in an upper direction; and a separator configured to prevent a subsequent flap envelope other than the flap envelope which is fed by the sheet feed roller, from moving in a sheet conveying direction and to separate the subsequent flap envelope from flap envelope, wherein the sheet feed tray is detachbly attachable to an apparatus body of the image forming apparatus while leaving the sheet guide in the apparatus body of the image forming apparatus.

11. The image forming apparatus according to claim 10, wherein the separator is downstream from the sheet guide in the sheet conveying direction and has a face inclined relative to a surface of the flap envelope accommodated in the housing.

12. An image forming apparatus, comprising:

a sheet feed tray including a housing configured to accommodate a flap envelope as a sheet and a side fence configured to regulate a position of the flap envelope in a width direction of the flap envelope;

a sheet feed roller configured to feed the flap envelope; and a sheet guide above the flap envelope and configured to regulate movement of the flap envelope in an upper direction, wherein the sheet feed tray is detachably attachable to an apparatus body of the image forming apparatus while leaving the sheet guide in the apparatus body of the image forming apparatus, wherein the sheet guide includes a contact part configured to contact a surface of the flap envelope, wherein the sheet guide is rotatably supported by the apparatus body of the image forming apparatus, wherein the contact part is configured to move up and down as the sheet guide rotates.

13. The image forming apparatus according to claim 12, wherein the sheet guide is configured to rotate about an axis extending along a direction perpendicular to a sheet conveying direction.

* * * * *